US005649697A

United States Patent [19]

Kurishita et al.

[11] Patent Number: 5,649,697

[45] Date of Patent: Jul. 22, 1997

[54] SHEET FEEDING APPARATUS

[75] Inventors: Toshirou Kurishita, Nara; Masahiro Kanezaki, Hiroshima, both of Japan

[73] Assignee: Sharp Kabushiki Kaisha, Osaka, Japan

[21] Appl. No.: 504,351

[22] Filed: Jul. 19, 1995

[30] Foreign Application Priority Data

Jul. 19, 1994 [JP] Japan ..... 6-167098
Jun. 12, 1995 [JP] Japan ..... 7-144879

[51] Int. Cl.[6] ..... B65H 3/14

[52] U.S. Cl. ..... 271/97; 271/98; 271/105; 271/108

[58] Field of Search ..... 271/97, 98, 99, 271/105, 108, 107

[56] References Cited

U.S. PATENT DOCUMENTS 4,397,459 8/1983 Silverberg et al. ..... 271/105 X
4,638,986 1/1987 Huggins et al. ..... 271/98
5,255,905 10/1993 Reid et al. ..... 271/98 X
5,356,127 10/1994 Moore et al. ..... 271/98 X

FOREIGN PATENT DOCUMENTS 57-160837 10/1982 Japan .
60-36248 2/1985 Japan .
1187137 7/1989 Japan .
3227840 10/1991 Japan .

OTHER PUBLICATIONS

Wenthe, Jr., Stephen J., "Stack Weight Sensing Paper Tray", Xerox Disclosure Journal, vol. 7, No. 4, Jul./Aug. 1982, p. 229.

*Primary Examiner*—David H. Bollinger

[57] ABSTRACT

A sheet feeding apparatus to control the injection quantity of air to a document bundle and to allow a stable supply of paper regardless of the document size, document quantity or curling of the document. In the case where air is blown by a separation air injection unit against the front edge of a document loading unit, document-floating sensors are provided protruding upward from a sheet feeding belt. The floating sensors can be for example contact-type sensors such as microswitches to set that injection amount of air to an optimum injection amount of air when the state of the floating sensors, changes compared to their initial state.

17 Claims, 20 Drawing Sheets

Fig. 11

| DOCUMENT SET STATE | | ASSUMED DOCUMENT | CHANGE AFTER AIR INJECTION | | SHUTTER VALVE STEPPING MOTOR |
|---|---|---|---|---|---|
| SENSOR 25a | SENSOR 25b | | SENSOR 25a | SENSOR 25b | |
| OFF | OFF | FEW SHEETS LIGHT | OFF | OFF | MIN STEPS (MIN AIR FLOWRATE) |
| | | | ON | OFF | |
| | | | OFF | ON | |
| | | | ON | ON | |
| ON | ON | MANY SHEETS HEAVY | OFF | OFF | STOP WHEN EITHER SENSORS 25a OR 25b TURNS OFF |
| | | | ON | OFF | |
| | | | OFF | ON | |
| | | | ON | ON | MAX STEPS (MAX AIR) |
| OFF | ON | UPWARD CURL | OFF | OFF | STOP WHEN SENSOR 25b TURNS OFF |
| | | | ON | OFF | |
| | | | OFF | ON | INTERMEDIATE STEP (AVERAGE AIR FLOW) |
| | | | ON | ON | |
| ON | OFF | DOWNWARD CURL | OFF | OFF | STOP WHEN SENSOR 25a TURNS OFF |
| | | | ON | OFF | MAX STEPS (MAX AIR FLOWRATE) |
| | | | OFF | ON | |
| | | | ON | ON | |

Fig. 15

START FULLY CLOSED

| TIME (msec) | | | START HALF OPEN | | START FULLY OPEN | |
|---|---|---|---|---|---|---|
| | AIR PRESSURE (mmAq) | OUTPUT RATE % | AIR PRESSURE (mmAq) | OUTPUT RATE % | AIR PRESSURE (mmAq) | OUTPUT RATE % |
| 0.0 | 0.0 | 0.0 | 0.0 | 0.0 | 0.0 | 0.0 |
| 100.0 | 0.4 | 0.9 | 0.2 | 1.2 | 0.5 | 1.5 |
| 200.0 | 1.9 | 4.3 | 0.8 | 5.6 | 1.9 | 5.9 |
| 300.0 | 4.3 | 9.8 | 1.6 | 11.2 | 4.4 | 13.7 |
| 400.0 | 7.3 | 16.6 | 2.8 | 19.8 | 7.3 | 22.4 |
| 500.0 | 10.8 | 24.5 | 4.0 | 27.9 | 10.3 | 31.7 |
| 600.0 | 13.8 | 31.4 | 5.2 | 35.9 | 13.4 | 41.5 |
| 700.0 | 17.2 | 39.1 | 6.3 | 43.6 | 16.2 | 50.1 |
| 800.0 | 21.0 | 47.7 | 7.4 | 51.3 | 18.8 | 58.0 |
| 900.0 | 23.8 | 54.1 | 8.4 | 58.9 | 21.1 | 65.3 |
| 1000.0 | 26.5 | 60.2 | 9.3 | 64.5 | 23.0 | 71.2 |
| 1100.0 | 28.9 | 65.7 | 9.9 | 69.3 | 24.2 | 75.3 |
| 1200.0 | 30.8 | 70.0 | 10.8 | 75.6 | 26.3 | 81.3 |
| 1300.0 | 33.5 | 76.1 | 11.4 | 79.2 | 27.3 | 84.6 |
| 1400.0 | 34.8 | 79.1 | 11.9 | 82.8 | 28.3 | 87.5 |
| 1500.0 | 36.0 | 81.8 | 12.4 | 86.2 | 29.0 | 89.8 |
| 1600.0 | 37.2 | 84.5 | 12.7 | 88.6 | 29.8 | 92.1 |
| 1700.0 | 37.8 | 85.9 | 12.9 | 90.3 | 30.4 | 94.2 |
| 1800.0 | 38.5 | 87.5 | 13.3 | 92.8 | 30.8 | 95.2 |
| 1900.0 | 39.5 | 89.8 | 13.5 | 94.0 | 31.1 | 96.2 |
| 2000.0 | 40.6 | 92.3 | 13.5 | 94.5 | 31.2 | 96.6 |
| 2100.0 | 41.0 | 93.2 | 13.6 | 95.1 | 31.3 | 96.9 |
| 2200.0 | 41.5 | 94.3 | 13.7 | 95.6 | 31.4 | 97.2 |
| 2300.0 | 41.8 | 95.0 | 13.8 | 96.3 | 31.5 | 97.6 |
| 2400.0 | 41.8 | 95.0 | 13.9 | 96.7 | 31.6 | 97.9 |
| 2500.0 | 42.2 | 95.9 | 13.9 | 97.3 | 31.7 | 98.2 |
| 2600.0 | 42.5 | 96.6 | 14.0 | 97.8 | 31.8 | 98.5 |
| 2700.0 | 42.8 | 97.3 | 14.1 | 98.4 | 31.9 | 98.9 |
| 2800.0 | 43.0 | 97.7 | 14.2 | 98.9 | 32.0 | 99.2 |
| 2900.0 | 43.2 | 98.2 | 14.3 | 99.5 | 32.1 | 99.5 |
| 3000.0 | 43.2 | 98.2 | 14.3 | 100.0 | 32.3 | 99.8 |
| 3100.0 | 43.5 | 98.9 | 14.3 | 100.0 | 32.3 | 100.0 |
| 3200.0 | 44.0 | 100.0 | 14.3 | 100.0 | 32.3 | 100.0 |

Fig. 17

| NO. OF STEPS | AIR PRESSURE (mmAq) | OUTPUT RATE % |
|---|---|---|
| 0.0 | 0.9 | 2.6 |
| 1.0 | 0.9 | 2.6 |
| 2.0 | 0.9 | 2.6 |
| 3.0 | 1.0 | 2.7 |
| 4.0 | 1.1 | 3.0 |
| 5.0 | 1.2 | 3.5 |
| 6.0 | 1.7 | 4.9 |
| 7.0 | 2.1 | 5.9 |
| 8.0 | 2.5 | 7.1 |
| 9.0 | 3.1 | 9.0 |
| 10.0 | 3.9 | 11.1 |
| 11.0 | 5.0 | 14.3 |
| 12.0 | 5.5 | 15.9 |
| 13.0 | 6.6 | 18.9 |
| 14.0 | 7.6 | 22.0 |
| 15.0 | 9.4 | 27.2 |
| 16.0 | 10.5 | 30.3 |
| 17.0 | 11.7 | 33.7 |
| 18.0 | 12.9 | 37.3 |
| 19.0 | 14.9 | 43.1 |
| 20.0 | 15.8 | 45.7 |
| 21.0 | 17.4 | 50.1 |
| 22.0 | 18.4 | 53.0 |

| NO. OF STEPS | AIR PRESSURE (mmAq) | OUTPUT RATE % |
|---|---|---|
| 23.0 | 20.3 | 58.5 |
| 24.0 | 21.1 | 61.0 |
| 25.0 | 22.5 | 64.9 |
| 26.0 | 23.6 | 68.1 |
| 27.0 | 25.2 | 72.7 |
| 28.0 | 25.8 | 74.4 |
| 29.0 | 26.9 | 77.6 |
| 30.0 | 27.7 | 79.9 |
| 31.0 | 28.9 | 83.5 |
| 32.0 | 29.8 | 86.0 |
| 33.0 | 30.3 | 87.6 |
| 34.0 | 31.0 | 89.6 |
| 35.0 | 32.0 | 92.3 |
| 36.0 | 32.3 | 93.2 |
| 37.0 | 32.9 | 95.1 |
| 38.0 | 33.2 | 96.0 |
| 39.0 | 34.0 | 98.1 |
| 40.0 | 34.2 | 98.7 |
| 41.0 | 34.3 | 99.1 |
| 42.0 | 34.5 | 99.7 |
| 43.0 | 34.6 | 100.0 |
| 44.0 | 34.6 | 100.0 |

0<NO. STEPS≦5
P=0.18×(NO. OF STEPS)+2.6

5<NO. STEPS≦9
P=1.38×(NO. OF STEPS)-3.4

9<NO. STEPS≦13
P=2.48×(NO. OF STEPS)-13.3

13<NO. STEPS≦27
P=3.84×(NO. OF STEPS)-31.1

27<NO. STEPS≦32
P=2.66×(NO. OF STEPS)+0.9

32<NO. STEPS≦38
P=1.83×(NO. OF STEPS)+27.3

38<NO. STEPS≦44
P=0.5×(NO. OF STEPS)+78

Fig. 21

| RPM (rpm) | AIR PRESSURE (mAg) |
|---|---|
| 4902.0 | 34 |
| 4870.1 | 33 |
| 4717.0 | 32 |
| 4717.0 | 31 |
| 4687.5 | 30 |
| 4573.2 | 29 |
| 4573.2 | 28 |
| 4464.3 | 27 |
| 4261.7 | 26 |
| 4166.7 | 25 |
| 4120.9 | 24 |
| 4098.4 | 23 |
| 4010.7 | 22 |
| 3947.4 | 21 |
| 3750.0 | 20 |
| 3676.5 | 19 |
| 3623.2 | 18 |
| 3537.7 | 17 |
| 3333.3 | 16 |
| 3289.5 | 15 |

Fig. 22

| SHUTTER VALVE FULLY OPEN | | | | SHUTTER VALVE FULLY CLOSED | | |
|---|---|---|---|---|---|---|
| PERIOD (ms) | | RPM (rpm) | AIR PRESSURE (mAg) | PERIOD (ms) | | AIR PRESSURE (rpm) |
| 1 | 3.1 | | | 1 | 2.6 | |
| 2 | 3.0 | | | 2 | 2.6 | |
| 3 | 3.2 | | | | | |
| 4 | 3.0 | | | | | |
| 5 | 3.0 | | | | | |
| AVG | 3.06 | 4902.0 | 34.0 | AVG | 2.60 | 5769.2 |

SHEET FEEDING APPARATUS

BACKGROUND OF THE INVENTION

1. Field of the Invention

This invention relates to a sheet feeding apparatus that separates and supplies paper from a bundle of stacked sheets of paper one sheet at a time. For example, the invention applies to an apparatus that supplies either documents stacked in a document tray or sheet papers stacked in a paper feed unit in an electrostatic copying machine.

2. Description of Related Art

A sheet feeding apparatus for documents in an electrostatic copying machine is described below by example.

As a sheet feeding apparatus that feeds document sheets stacked in a document tray from the lowermost portion in order one at a time in an electrostatic copying machine there is an apparatus that injects air to the front edge (downstream side of feeding direction) of the document bundle to prevent duplicate feeds of the documents. In this case, it is necessary to set the injection quantity of air to an appropriate amount and, a construction to achieve this is shown in Japanese Unexamined Patent Publications No. 57-160837 and 60-36248.

If the construction mentioned in Japanese Unexamined Patent Publication No. 57-160837 is summarized, it is a construction that measures the frictional force between the stack (document bundle) and a tray and, depending on this frictional force, controls the injection quantity of air. The two methods below are mentioned as means to measure the frictional force for this case. One of the methods uses a solenoid to obtain time as frictional force from after the stack is ejected at a fixed distance until it returns. If the injection quantity of air is correct and the stack floats from the tray in an appropriate state (if an adequate gap is formed between both), the stack returns in the correct time although, if the injection quantity of air is small, the stack will not return to its original position. The injection quantity of air is thus obtained. The other method uses a light sensor to directly detect the gap between the tray and the stack and to use this as a value corresponding to the frictional force.

Further, if the construction mentioned in Japanese Unexamined Patent Publication No. 60-36248 is summarized, it is a construction that measures the document stack stacked in a loading unit by a sensor as height, namely measuring the stack as height in response to the number of documents stacked to control the injection quantity of air in response to the height of this stack. Therefore, in this construction, the injection quantity of air is determined in response to the number of sheets comprising the document stack height to be loaded and, the loaded stack is made afloat by the air.

However, these conventional types of constructions have the following problems.

For the construction mentioned in Japanese Unexamined Patent Publication No. 57-160837, the stack must be floated completely to form the gap, thus making control difficult depending on the paper size or document quantity. For example, if the document size is small, the entire stack can float although, if the document size becomes large, floating the entire stack becomes difficult. In other words, if the injection quantity of air is raised even slightly too much with large sized documents, the documents will warp and then will not completely float. Further, if the stack is large (large quantity of document sheets), the stack can be floated by increasing the injection quantity of air. However, a great deal of time is required until the stack completely floats and the construction is not suitable for recent copying machines which must compete for the time until the first copy.

Moreover, for the construction mentioned in Japanese Unexamined Patent Publication No. 60-36248, the height of the stack is detected although, in an actual document, there are many occurrences of curls and other problems thus, errors occurred in detecting the size of the stack, which made it impossible to control a correct injection quantity of air. For example, if an upward curl occurred in the document, the height of the stack would be detected larger than the actual stack and the injection quantity of air would be set larger than necessary, resulting in the excessive document floating. This led to paper jams due to poor paper feed (paper supply mistake). Also, if an downward curl occurred in the document, the height of the stack would be detected smaller than the actual stack and the injection quantity of air would be insufficient, thus resulting in duplicate feeds.

SUMMARY OF THE INVENTION

The object of this invention is to provide a sheet feeding apparatus that can eliminate the above problems by detecting a floating state of a sheet and, based on that state, setting the injection quantity of air.

Furthermore, the object of the invention is to more reliably feed one sheet of paper by directly detecting sheet floating, detecting a state in which this floating position becomes a prescribed position, and making it possible to control an injection quantity of air that can maintain this state.

According to a first aspect of the invention, there is provided a sheet feeding apparatus that separates individual sheets from a sheet bundle and thereafter feeds one sheet at a time by injecting air against the front edge of the sheet bundle, said apparatus comprising:

detecting means disposed on a sheet loading unit underneath the sheet bundle, the detecting means detecting a floating state of the sheet bundle from the sheet loading unit; and means for maintaining the injection quantity of air at the time when the floating state of the sheet bundle to be detected by the detecting means changes after the start of the air injection.

According to a second aspect of the invention, there is provided a sheet feeding apparatus that separates individual sheets from a sheet bundle and thereafter feeds one sheet at a time by injecting air against the front edge of the sheet bundle, said apparatus comprising:

detecting means disposed on a sheet loading unit underneath the sheet bundle, the detecting means detecting a floating state of the sheet bundle from the sheet loading unit prior to the start of the air injection and after the start of the air injection;

means for gradually varying the injection quantity of air after the start of the air injection; and means for detecting a floating state of the sheet bundle after the start of the air injection and controlling the injection quantity of air in response to the relationship between the floating state of the sheet bundle after the start of the air injection and the floating state of the sheet bundle prior to the start of the air injection.

According to a third aspect of the invention, there is provided a sheet feeding apparatus that separates individual sheets from a sheet bundle and thereafter feeds one sheet at a time by injecting air against the front edge of the sheet bundle, said apparatus comprising:

means for injecting air including a fan, a duct and a shutter, the duct running from the fan to the front edge of the sheet bundle and the shutter disposed inside the duct to open or close an air path in stages;

detecting means disposed on a sheet loading unit underneath the sheet bundle, the detecting means detecting a floating state of the sheet bundle from the sheet loading unit;

means for gradually varying the injection quantity of air by starting rotation of the fan with the shutter open; and means for setting the stages of opening and closing of the shutter to maintain the injection quantity of air at the time when the floating state of the sheet bundle to be detected by the detecting means changes after the start of the rotation of the fan.

Furthermore, according to a fourth aspect of the invention, the sheet feeding apparatus controls the injection quantity of air by directly detecting the sheet floating state. Consequently, it comprises a distance measurement sensor disposed on a sheet loading unit underneath a sheet bundle that measures the distance from the loading unit to the lowermost portion of the stacked sheet bundle; means for injecting air to the front edge of the sheet bundle; and means for controlling the injection quantity of air with the injection means by floating the sheets by air injection using the injection means and fixing the measured distance of the distance measurement sensor at a prescribed value.

According to a fifth aspect of the invention, the sheet feeding apparatus indicated above comprises a plurality of contact type sensors or distance measurement sensors to detect floating of the sheets as well as to detect curling of the sheets in response to the detection state by these sensors in addition to control the injection quantity of air in consideration of the curling of the sheets or the like.

In the first aspect of the invention, when the floating state of the sheet bundle changes after the start of air injection to the front edge of the sheet bundle or, when the sheet bundle floats, the injection quantity of air is determined as a correct injection quantity of air and is to be maintained as such. This action maintains the injection quantity of air at the minimum state required to float the sheet bundle.

A state in which the sheet bundle is floating is detected and, in response to that, the injection quantity of air to be blown to the front edge of the sheet bundle is set, thus allowing an optimum injection quantity of air required to float the sheet bundle to be set and causing to separate the front edge of each sheet.

In the second aspect of the invention, a comparison is made between the floating state (detection state by the detection means) of the sheet bundle when air is not being injected and the floating state of the sheet bundle after the air injection starts and the injection quantity of air is controlled in response to the relationship between these two. The floating state of the sheet bundle when the air is not being injected differs for each sheet bundle that is set. For example, when the sheet is curled or is extremely light, there is a possibility the floating of the sheet will be detected at the time the sheets have been stacked. In such case, the injection quantity of air is controlled during this time not only in response to the floating state of the sheet bundle after starting the air injection, but also in response to the relationship between the state before the air injection starts and after the air injection starts. For example, when a part of the sheet bundle is floating initially, the optimum state for the injection quantity of air is determined when areas other than that floating portion are floating, and the injection quantity is set to that value. Consequently, in response to the curling state of the sheet bundle or the weight of the sheet bundle, controlling is carried out, thus allowing air injection that corresponds with the sheet bundle.

In the third aspect of the invention, when the feeding of sheets starts, at first, the operation of the fan starts with the shutter open. The rotation of the fan gradually increases and, with that increase, the injection quantity of air blown on the front edge of the sheet bundle changes. At this point the sheet bundle may float before the rotation of the fan sufficiently starts. This indicates that the required injection quantity of air for the sheet bundle has been obtained by the amount the shutter opens and closes being smaller than the current amount the shutter opens and closes. Therefore, in this case, in order for the injection quantity of air to be correct, the amount the shutter opens and closes should be made smaller than the current one in stages. In this way, in order to maintain the injection quantity of air at a time when the floating state of the sheet bundle changes, a correct injection quantity of air can be obtained by setting the amount the shutter opens and closes in stages. With this construction, the air injection to the sheet bundle starts simultaneously with the start of the operation of the fan. Thus, the injection quantity of air can be determined quickly in stages when the required the injection quantity of air is small. In other words, the required injection quantity of air can be determined in earlier stages compared to control by opening the shutter after the fan has started sufficiently. As a result, the initial sheet feed timing can be made faster.

In the fourth aspect of the invention, the front edge of the sheet bundle is loosened by injecting air into the stacked sheet bundle using an injection means. At this time the sheets tend to float in response to the injection quantity of air. Also, at this time, the distance measurement sensor detects the floating state of the lowermost portion of the sheet bundle. This carries out the measurement as the direct distance using the distance measurement sensor when the lowermost portion of the sheet floats from the loading unit. Because of this, the floating state of the lowermost portion of the sheets can be accurately detected and by confirming this floating state, the injection quantity of air can be accurately controlled as a floating state by the injection means. This makes the air quantity injected to the front edge of the sheet bundle correct. In particular, the sheet can be floated at a predetermined position and that floating position can be maintained, thus allowing one sheet of paper to be accurately bed.

In the sheet feeding apparatus stated above, the state of the sheets can be determined by providing a plurality of contact-type sensors or distance measurement sensors as a means to detect floating of the sheets. Namely, a state such as curling of the sheets, waves or folding can be detected. For example, if the plurality of sensors detect a state in which all sheets are stacked, with the sheets flat, whether curling, waves, or folding is occurring can be detected. Further, if a part of the sensors detects a non-stacked state of the loaded sheets, whether the document is floating, curling, becoming wavy or folding is detected at that position. In this way, the state of the sheets can be detected by the plurality of sensors and, in response to that state, it is possible to accurately control the injection quantity of air required to float and separate the sheets.

BRIEF EXPLANATION OF THE DRAWINGS

For a better understanding of the invention as well as other objects and features thereof, reference is made to the following detailed description to be read in conjunction with the accompanying drawings.

FIG. 3A is a cross-sectional view showing the arrangement of air nozzles which inject air and FIG. 3B is a partial cross-sectional view showing the shape of the air nozzles which inject air.

FIG. 6A is a side view of the sensor and FIG. 6B is a front view of the sensor.

FIG. 11 is a table showing a setting example for the injection quantity of air in response to the floating detection stale of a floating sensor.

FIG. 15 is a table showing the injection quantity of air (air pressure) when a separation fan actuates.

FIG. 17 are tables showing the relationship between the injection quantity of air pressure and the number of open/close steps of a shutter valve.

FIG. 21 is a table showing the relationship between the rpm of the separation fan and the injection quantity of air (air pressure).

FIG. 22 is a table showing changes of the rpm of the separation fan and the injection quantity of air (air pressure) when the degree of opening/closing of the shutter value has changed.

DETAILED EXPLANATION OF THE PREFERRED EMBODIMENT

Figure 1:
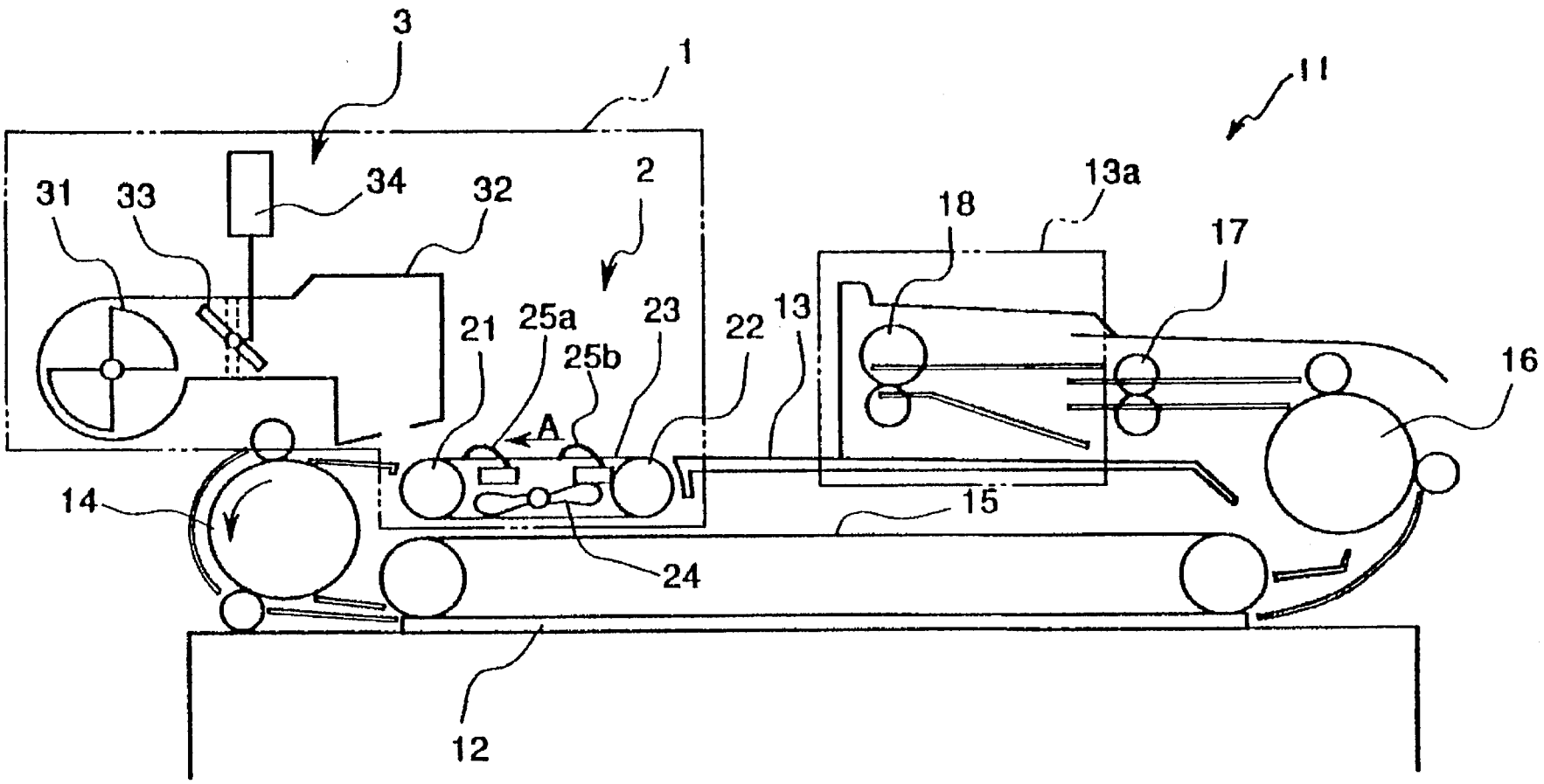
FIG. 1 is a schematic view of an RHD provided with the sheet feeding apparatus of this invention.

Referring to the drawings, the preferred embodiment of this invention are described in detail below.

(i) Construction of the Apparatus

FIG. 1 shows a partial schematic view of an RDH (recirculating document handler) provided with the sheet feeding apparatus according to this invention applied to an RDH of a copying machine.

The RDH 11 is arranged on top of a document table 12 of the copying machine main body. The RDH 11 supplies document sheets on the document tray 13 using a sheet feeding apparatus 1, a feeding roller 14 and a feeding belt 15 to the top of the document table 12. Then, when the copying process of the document on top of the document table 12 completes, the feeding belt 15 and the delivery rollers 16, 17, 18 return that document to the document tray 13 again. At this time, from among the documents on the document tray the document at the lowermost position of the stacked document bundle is taken out, fed and then returned to the uppermost position of the document bundle. In this way, while the document at the lowermost position is fed in order, the copy process is executed and documents which have been copied, are returned to the uppermost position of the document bundle.

When a plurality of copies are taken in this type of RDH 11, only that number of recirculated documents are repeated. Therefore, in the RDH, with increasing the paper feeding frequency corresponding to the number of copies, reliability for preventing duplicate feeds are becoming important and thus, document separation control using injected air is becoming important as well.

The sheet feeding apparatus 1 is provided with a sheet feed suction unit 2 and a separation air injection unit 3.

(1) Construction of the Sheet Feed Suction Unit

The sheet feed suction unit 2 is provided with a sheet feeding belt 23 that applies tension between rollers 21, 22, a suction fan 24 and floating sensors 25*a*, 25*b*.

(1) Construction of the Sheet Feeding Belt and Suction Fan

Figure 2:
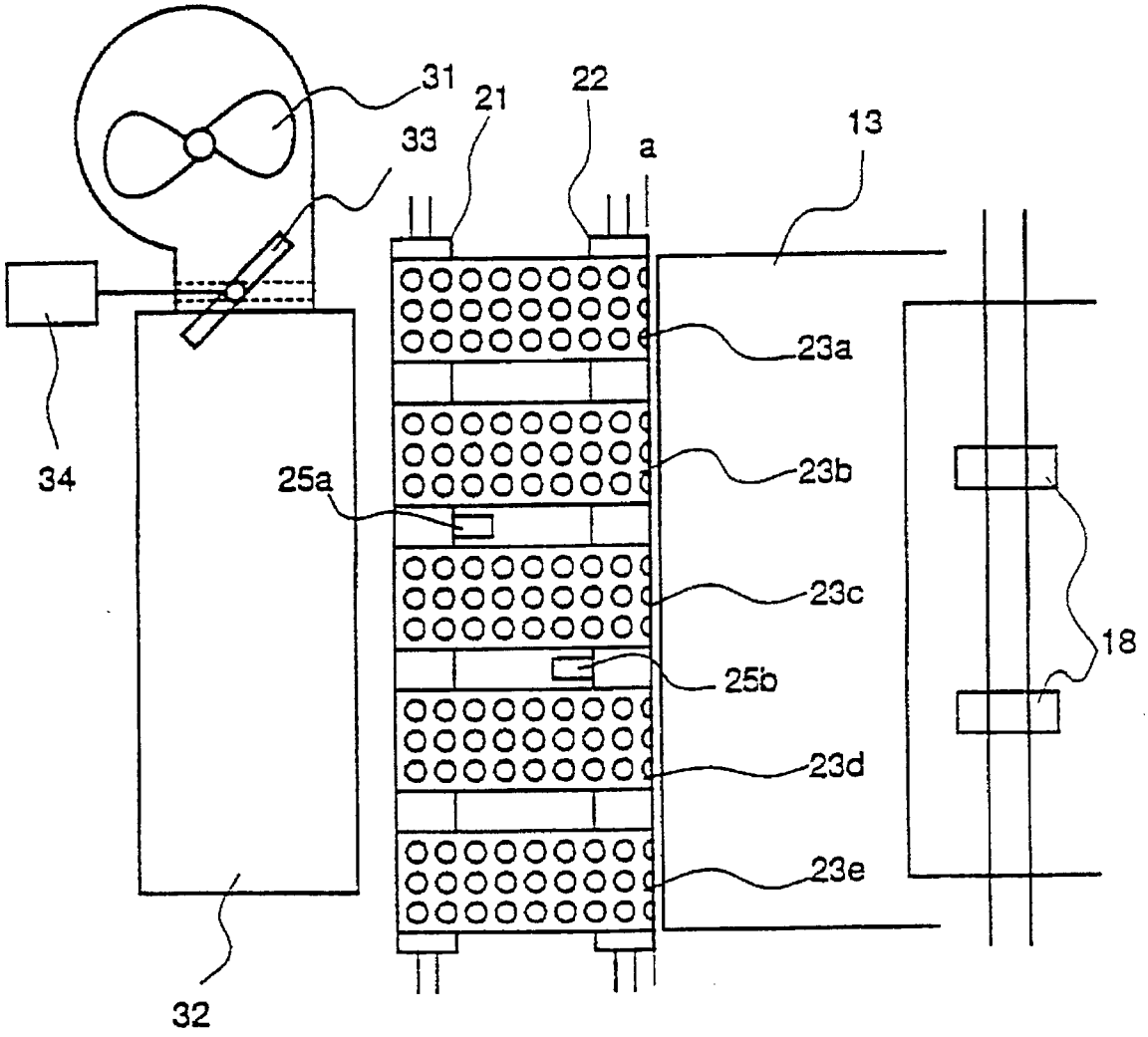
FIG. 2 is a top plan view of the sheet feeding apparatus described in FIG. 1.

FIG. 2 shows a top view of the sheet feeding apparatus 1. The sheet feeding belt 23 comprises a number of narrow belts 23*a*, 23*b* . . . 23*e* arranged lengthwise by applying tension between the rollers 21, 22 with a plurality of holes being formed on the surface of each belt to let air pass through. The sheet feeding belt 23 is arranged so that its top face is continuous to the document tray 13, and the document bundle can be stacked on the document tray 13 as well as on the sheet feeding belt 23. Defining guides (not shown in the figure) are provided on the front and rear portions of the document tray 13 as seen from the document feed direction to prevent diagonal feeds of the document and even further, a guide unit 13*a* is provided at the upstream portion relative to the document feed direction (direction of arrow A) for guiding the rear edge of the document. The defining guides and guide unit 13*a* slide in response to the size of the document to be stacked to guide the stacked document. A suction fan 24 and shutter (not shown in the figure) are disposed inside the sheet feeding belt 23. The suction fan 24 sucks the document on top of the sheet feeding belt 23 and with the sheet feeding belt 23 rotating in that state, the document at the lowermost position being sucked is fed.

(2) Construction of Floating Sensors

The floating sensors 25*a*, 25*b* comprise contact type sensors such as a microswitch. The actuator portion protrudes at the upper surface of the sheet feeding belt 23 to detect a contact state of a document on the upper surface of the sheet feeding belt 23.

The floating sensors 25*a*, 25*b* are disposed between each belt of the sheet feeding belt 23 comprising a plurality of belts. The number of floating sensors installed can be only one although, in this embodiment, a plurality of sensors such as two are arranged so as to allow a document floating state to be detected by respective ON/OFF state of these sensors. When a plurality of floating sensors are used, the detection state of each sensor changes by either a wavy or curling state of a document, a floating state of one part of a document caused by two or three folds or a stacked state of documents in the document tray 13 thus, making it possible to detect a floating state while discovering these states. In FIG. 2, there is shown a concrete installation example of the floating sensors.

The construction of the sheet feed suction unit 2 according to the invention has the sheet feeding belt 23 divided into five sections (belts 23*a*, 23*b* . . . ) and the floating sensors 25*a*, 25*b* are disposed on both sides of the center belt 23*c*. The floating sensors 25*a*, 25*b* are located farther upstream than the point where the previously stated air injection is carried out relative to the document feed direction A and are disposed farther downstream than point "a" shown in the figure. This point "a" is the center position relative to the direction the document is fed (direction of arrow A) when the smallest-sized documents that can be fed are stacked into the RDH. By disposing the floating sensors 25*a*, 25*b* at this position, the responsiveness of the floating detection of the document can be improved. This is due to the reasons described below.

Because the air required to float the document bundle is injected from the front edge portion downstream side of the sheet feeding direction of the stacked document by the separation air injection unit 3, the front edge side of the document bundle (portion on the downstream side) tends to float while the rear edge side of the document bundle (portion on the upstream side) is difficult to float. Consequently, by providing a floating sensor on the upstream side of the document bundle, floating of the document is not detected until almost the entire documents have floated and, during this time, document can not be fed. On the other hand, by providing a floating sensor on the downstream side of the document bundle, when the document bundle on the downstream side floats, a floating state will be detected even if the upstream portion is not floating and document will be fed. Because of this, document feed can be done at the time the downstream side floats even when the amount of stacked document sheets is large and some time is required until the entire document bundle floats thus, the fast copy time is shortened.

Further, if one portion on the downstream side forming the front edge side of the document floats during the document feed, there will be no duplicate feed problems. In particular, the construction of this embodiment is such that point "a" is equal to the rear edge of the sheet feeding belt 23 and, because the floating edge portion of the document is fed by the sheet feeding belt 23 with tension applied to the rear portion being fed, there will be no further problems. Also, as stated above, point "a" is the position that becomes the center of the smallest-sized document that can be fed, allowing sufficient detection even when the document size is small.

The two floating sensors 25*a*, 25*b* are disposed on both sides of the belt 23*c* as stated previously and, the respective positions relative to the document feeding direction (direction of arrow A) are deviated. In this embodiment, the floating sensor 25*a* is situated on the downstream side and the floating sensor 25*b* is situated on the upstream side. Because of this arrangement, there are no influence arising from the curling, waving, folding or stacked state of the document which causes the floating state of the document to be detected. Moreover, even if more floating sensors are arranged, in the same way, the position relative to the direction of arrow A and the position relative to the direction perpendicular to the direction of arrow A is shifted between the respective sensors, it will become possible to detect the floating state of the document without any influence arising from the curling, waving, folding or stacked state of the document. For example, if there is no curling in the document or absolutely no problem with the stacked state, all the floating sensors detect the presence of a document when the documents are stacked. However, when there is curling of the document or a poor stacked state, a document floating state will occur from one floating sensor and that sensor will not detect the document. If a plurality of sensors comprise the floating sensors, this type of document state can be detected beforehand and, by utilizing the detection state of a sensor for that initial state, the floating state of the document can be detected.

(3) Others

A drive system not shown in the figure transmits a rotational force to a roller 21 of the sheet feed suction unit 2 which rotates in the direction of feeding the document on the sheet feeding belt 23 as indicated by the arrow shown in the figure. Thus, the document at the lowermost position can be fed.

(2) Construction of the Separation Air Injection Unit

The separation air injection unit 8 is disposed in the upper direction at the downstream side (sheet feeding side edge of the document bundle) of the sheet feed suction unit 2. The separation air injection unit 3 is provided with a separation fan 31, a duct 32 that guides air discharged from the separation fan 31 to the front edge portion of the document bundle, and a shutter valve 33 that opens and closes the duct 32. The shutter valve 33 is opened and closed by a stepping motor 34. By opening and closing the shutter valve 33, the injection quantity of air blown to the front edge of the document bundle on top of the document tray 13 and the sheet feeding belt 23 is adjusted to control the floating state of the document bundle at a suitable state. The shutter valve 33 is opened and closed in response to the detection state of the floating sensor 25. One of the features of the invention adjusts the open/close state of the shutter valve 33.

Figure 3A:
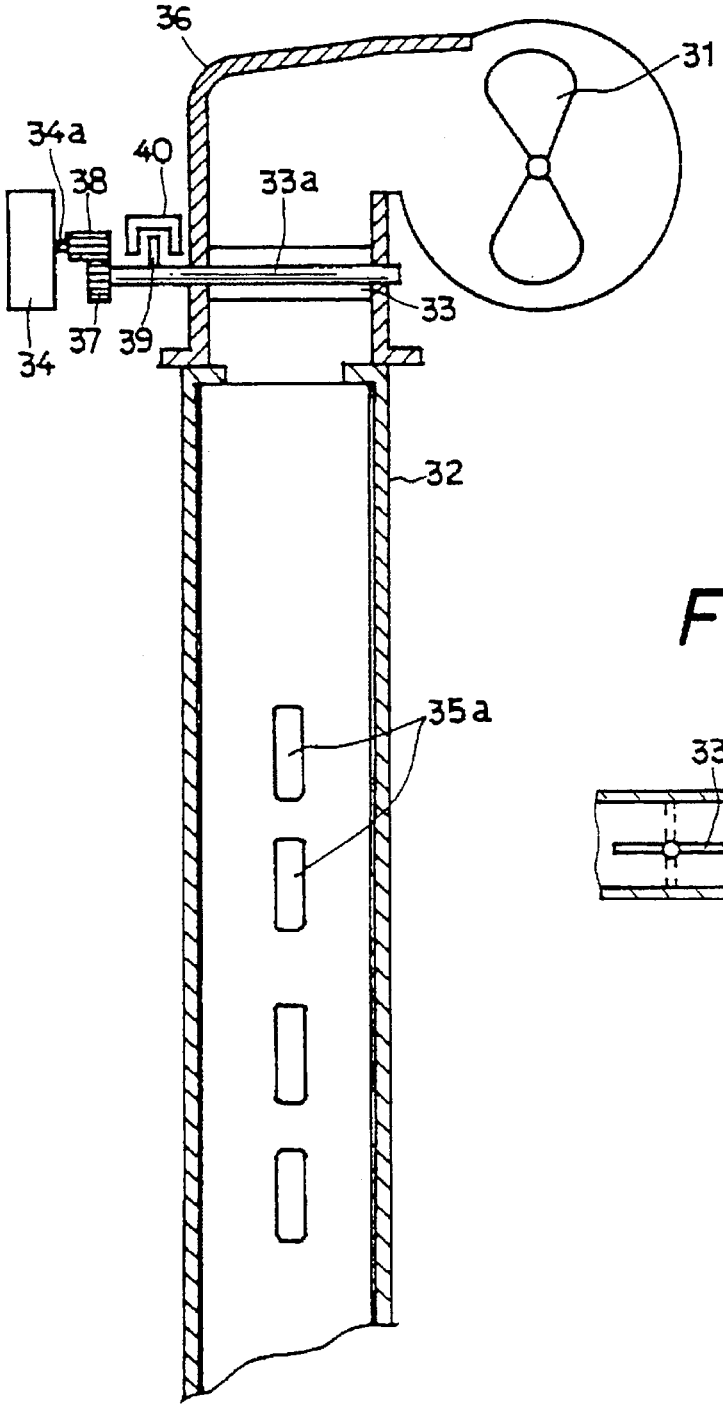
FIGS. 3A and 3B are views showing details of an air injection unit installed in the sheet feeding apparatus of the invention.
Figure 3B:
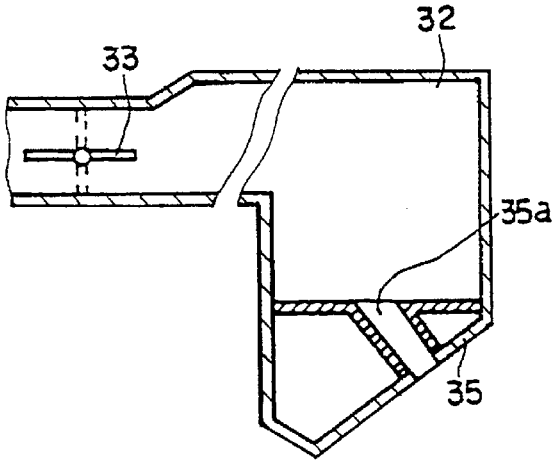

The separation air injection unit 3 is shown in FIG. 3 (A) and (B) as shown by the detailed construction and is provided with an air nozzle 35 on the bottom inside the duct 32 having a blowing outlet separated into pluralities to inject air to the front edge portion on the feeding side of the document bundle. The edge of this air nozzle 35 is formed in a shape to allow air injection from the diagonal upper direction to the edge of the document bundle. While this construction allows air to inject to the edge of the document bundle, the nozzle is adjusted to inject air to the position to float the lowermost portion of the document bundle from the sheet feeding belt 23 especially.

Further, the duct 32 is connected to the separation fan 31 via a connecting portion 36 and is provided with a rotatable shutter valve 33 on the connecting portion side close to that connecting portion 36. Around a rotating shaft 33*a* of the shutter valve 33 a driven gear 37 fixed at a position protruding from the connecting portion 36 meshes with and a drive gear 38 connected to a rotating shaft 34*a* of the stepping motor 34 and is there provided with a photocupler 40 that detects a slit of a slit disk 39 fixed to the side of the rotating shaft 33*a* of the shutter valve 33.

The slit disk 39 is provided to indicate the rotational position of the shutter valve 33 and especially the open/close state. By detecting the slit with the photocoupler 40, the rotational position of the shutter valve 33 can thus be found. In particular, the slit disk 39 need not be a round shape and, from the fully open position of the solid lines in FIG. 3B the shutter valve 33 is rotated 45 degrees to the closed positions indicated by the broken lines. Thus, a fan shape of at least 45 degrees is sufficient.

The separation air injection unit 3 stated above can adjust the injection quantity of air blown from the air nozzle 35 in response to the open/close state of the shutter valve 33 by the rotation of the separation fan 31. This adjustment can be accomplished by controlling the rotation angle of the stepping motor 34.

(ii) Examples

The controlling mode of the injection quantity of air is described below.

<Example 1>

The first example of the invention is described.

Figure 4:
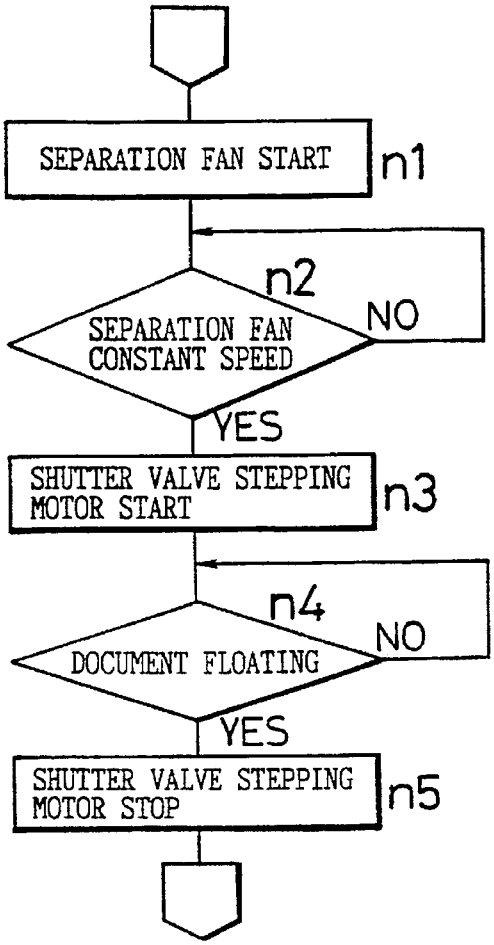
FIG. 4 is a flowchart showing a process related to a first embodiment of the invention.

FIG. 4 is a flowchart showing a process to set the injection quantity of air.

By executing the timing of the document feed using print switches, at first, the separation fan 31 turns ON and begins to rotate (n1). After that, the separation fan 31 reaches a prescribed speed after a fixed time. When this occurs, the stepping motor 34 operates gradually, opening the shutter valve 33 (n2→n3). This injects air to the front edge of the document bundle and that injection quantity of air is gradually increased. When this occurs, the front edge of the document bundle floats and the ON/OFF state of the floating sensors 25*a*, 25*b* changes. The changes in the ON/OFF state of the floating sensors can be either from ON to OFF or from OFF to ON although normally, after the actuator of the sensor is pressed by the document, the state is ON initially and then changes to OFF because the document floats by air injection air. However, if the document is curled, initially, the state will be OFF because the document does not press the sensor and flapping when the document floats will cause the state to momentarily change to ON. Since this type of state shows ease of movement of the document (easy to feed), the injection quantity of air during this time is judged to be correct. Therefore, when the state of the floating sensors 25*a*, 25*b* changes, the operation of the stepping motor 33 stops and the open/close state of the shutter valve 33 at that time is maintained (n4→n5).

Figure 5:
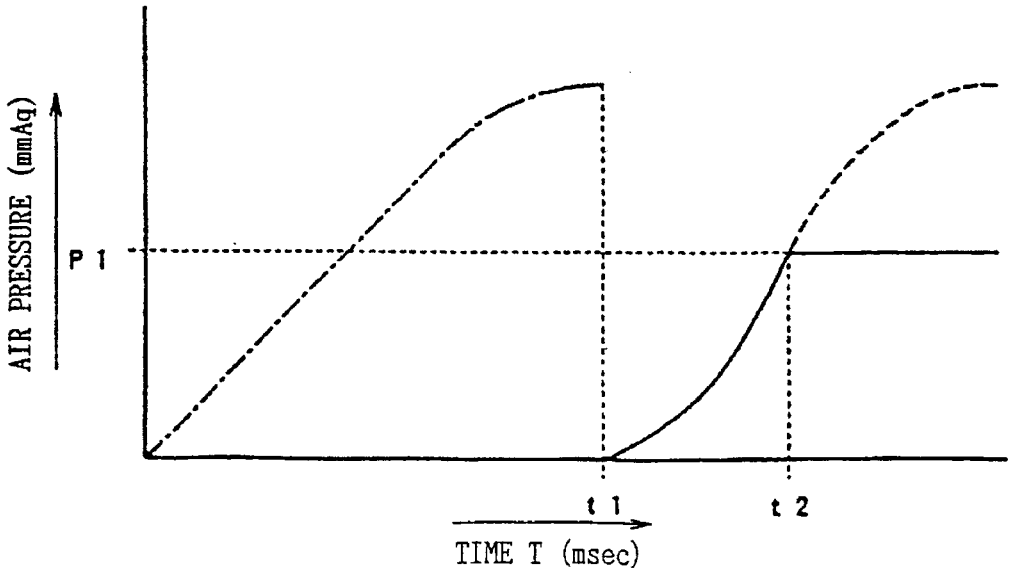
FIG. 5 is a view showing an example of changes to the injection quantity of air when the process of FIG. 4 is carried out.

FIG. 5 is a figure showing the stage of the pressure change of the separation air injection unit 3 when this control is executed. In the figure, time is in the horizontal axis and pressure of the air injection in the vertical axis. The solid lines in the figure indicate air pressure blowing to the document bundle and the alternate long and short dash line indicates the pressure inside a separation fan 31 housing portion before the shutter valve opens. After the separation fan 31 turns ON, the shutter valve opens after a fixed time (t1). When this occurs, the pressure of the air blowing to the document bundle gradually increases and floating of the document is detected by a certain timing (t2). When this occurs, the shutter valve stops at that present state and then after that, a constant pressure P1 is maintained. In this way, while the air is injected at a constant pressure P1, the document is fed by the sheet feed suction unit 2.

The feeding operation of documents using the sheet feed suction unit 2 is described. The suction fan 24 of the sheet feed suction unit 2 turns ON at almost the same time as the separation fan 31. Then, when the floating sensors 25*a*, 25*b* turn OFF, the shutter opens after that fixed time and suction of the lowermost document in the document bundle starts. This action sucks the lowermost document in the document bundle to the sheet feeding belt 23 and along with this, starts rotation of the sheet feeding belt 23. This action feeds the lowermost document. This document is transferred to a prescribed position on the document table 12 by the feeding roller 14 and the feeding belt 15.

In the above description, the floating sensors 25*a*, 25*b* which use a microswitch as a mechanical detection means detect the floating state of the document on the document tray 13 and the sheet feeding belt 23, which, together comprises the loading portion to stack documents. The operating position of these sensors 25*a*, 25*b* is different when the switch state changes (for example ON→OFF) at the time the document floats from the position the stacked document was detected compared to when the switch state changes (OFF→ON) at the time the floating document lowers and the stacked document is detected. Consequently, even if sensors 25*a*, 25*b* which are adjusted to an ON operating state by the switch are provided when the document was stacked in the document tray 13, the switch state will not change (ON→OFF) as long as the documents do not float at a considerable distance from the document tray. Also, even if the document drops down to the document tray 13 in a floating detected state, that document dropping state cannot be detected as long as the document is floating.

Figure 6A:
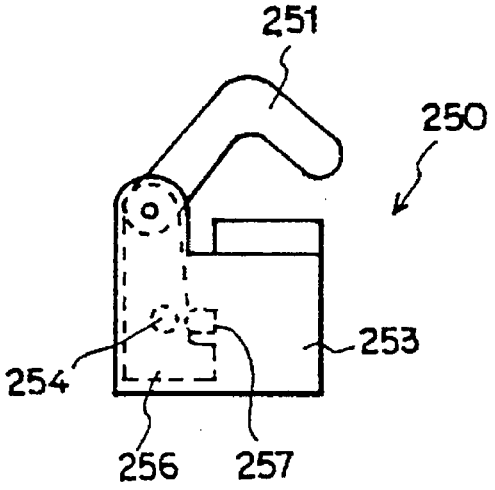
FIGS. 6A and 6B show one example of a sensor in an optical detection means in place of a microswitch to detect the floating state of a sheet according to the invention.
Figure 6B:
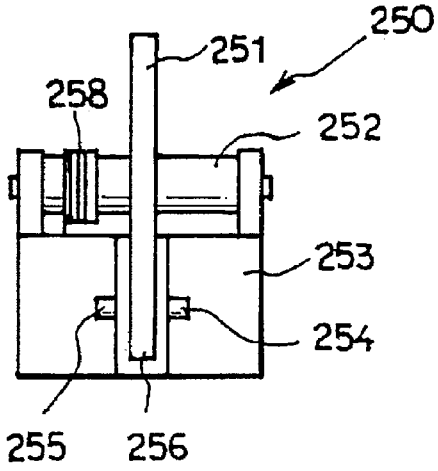

Accordingly, if the technical problem of controlling the injection quantity with accuracy higher than the detection state using the floating sensors 25*a*, 25*b* which use a microswitch is at issue, the use of an optical sensor can be considered. FIG. 6 shows an example of this optical sensor. In the figure, a sensor 250 is provided with a shaft 252, integrally formed with an actuator 251, which is rotatable on both sides of a support portion 253 with the lower portion of the actuator 251 functioning as a cover 256 to block the light path of a light emitting element 254 and a light receiving element 255 disposed on the support portion 253.

Further, a restricting stopper 257 is provided on the side of the support portion 253 to restrict the rotation of the cover 256 and, a coil spring 258 is provided to apply force to hold the cover 256 to the restricting stopper 257 on the shaft 252.

Therefore, as shown in FIG. 1, by arranging the sensor 250 so that one portion of the actuator 251 protrudes from the surface of the sheet feeding belt 23 at a plurality of locations, the actuator 251 rotates in opposition to the force applied by a spring 258 by the document sheets to be stacked from that upper portion. At this time, the cover 256 releases the blocked state of the light path of the light emitting and receiving elements 254, 255, resulting in the light receiving element 255 receiving light and the document to be stacked being detected by an ON state. Further, air is injected in this state and if the document floats from the sheet feeding belt 23, the document separates from the actuator 251. By this action, the cover 256 blocks the light path stated above cutting off the light to the light receiving element 255, resulting in an OFF state thus detecting a floating state of the documents.

With the optical sensor, the timing to change from ON→OFF or from OFF→ON almost coincides as opposed to a mechanical sensor using a microswitch. Consequently, the detection of whether or not there is a floating state can be detected with even more accuracy than with a microswitch. By more precisely detecting a floating state, this action can precisely adjust the injection quantity of air that maintains the floating at a prescribed state from the sheet feeding belt 23 (loading portion) of the document.

On the other hand, according to the previously stated mechanical sensor and optical sensor (collectively referred to as contact-type sensors), when a floating state of the documents are detected, the state of the switch is either ON or OFF. Consequently, a floating state by itself cannot be detected. Briefly, it is unclear how the floating state is separated from the sheet feeding belt 23. Thereby, even when the injection quantity of air is even greater than for a correct floating state (over), by only detecting a floating state, an over-float state cannot be detected.

Therefore, when the injection quantity of air is over, there is a possibility the document will float beyond the correct position making it impossible to suck the lowermost document to the sheet feeding belt 23, with malfunction in feeding resulting in feed errors. Therefore, as stated in the above embodiment, the injection quantity of air is controlled to gradually increase and make it effective to maintain the injection quantity of air at a state in which the floating is detected.

If it is possible to find a solution to the problem of precisely detecting that floating position, then it is possible to control the injection quantity of air to allow a floating state with an even higher degree of accuracy to be maintained.

For an example of this, if the distance from the position of the document on the loading portion to the sensor that detects the floating can be measured, the previously stated problem can be solved.

For a sensor that can measure this distance, for example, the "8-bit control distance sensor" described in the 1992 October Vol. 12 issue of "Sensor Technology", PP 24–27 can be utilized. This sensor is called an PSD (Position Sensitive Detector) and illuminates light from a light emitting element to an object to be measured and carries out the measurement using the incident position toward the sensor of the light reflected from that object.

Figure 7:
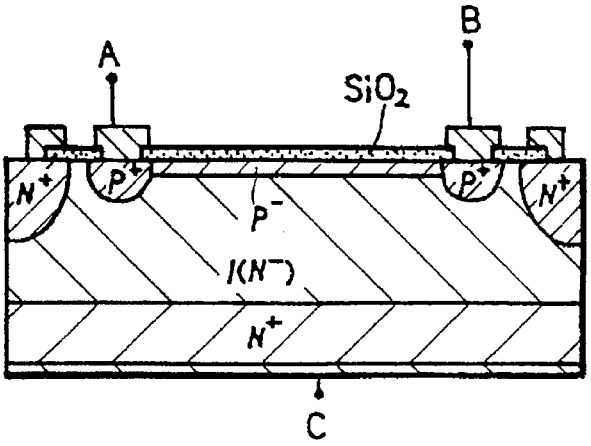
FIG. 7 shows another example of a sensor to detect the floating state of a sheet according to the invention, which is a cross-sectional view of a distance measurement sensor.
Figure 8:
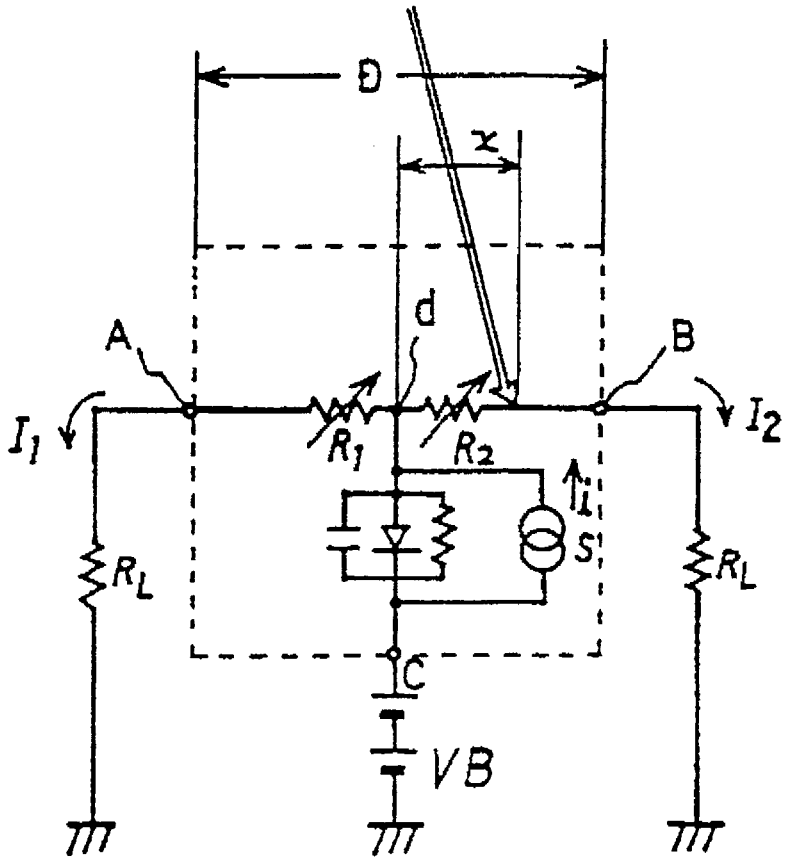
FIG. 8 shows an equivalent circuit of the distance measurement sensor of FIG. 7.

To simply describe this sensor, it is one kind of PIN type photodiode and, as shown in FIG. 7, comprises a p-layer on the front surface of a silicon chip, a n+ layer on the rear surface, and an i layer between those layers with electrodes A, B and C provided on each of the surface and rear layers as shown in the figure. FIG. 8 shows an equivalent circuit using the PSD sensor of the construction shown in FIG. 7.

In FIG. 8, by supplying a bias voltage VB to the terminal of electrode C, resistance R1 and R2 change depending on the position of the light incoming to the front surface (spot position). For example, if light is incoming to a center point between electrodes A and B (point d), then R1:R2=1:1 although if that incident light distorts toward either the A or B electrode, the R1:R2 ratio will change in proportion to that position. Supposing that, the incident position of the light is incoming to a position shifted toward the B electrode at x with respect to the center position d and D is the length (distance between the A and B electrodes) of the light receiving surface of the sensor, then, when R1+R2=R0, the relationship below will hold.

$$R1=R0/2\ (1+2x/D)$$

$$R2=R0/2\ (1-2x/D)$$

Therefore, using the above resistance change, the incident position of the light of the receiving surface of the PSD sensor, is represented as a change of electrical currents I1 and I2 flowing from electrodes A and B in FIG. 8 with the electrical current ratio I1/I2 being in proportion to the distance of the incident position from electrode B. Then, the incident position of the light is in proportion to the electrical current ratio I1/I2 although the absolute values of electrical currents I1 and I2 change depending on the amount of light incoming to the PSD sensor and thus, there is no influence due to that amount of light. Thereupon, this relationship of the electrical current ratio I1/I2 allows the position of the incident light of the receiving surface of the PSD sensor to be specified and therefore, allowing precise distance measurements. In particular, increasing the electrical current ratio I1/I2 will result in the incident light moving close to the electrode A side of the PSD sensor. Conversely, the incident light is illuminated to the electrode B side as the electrical current ratio becomes smaller.

Figure 9:
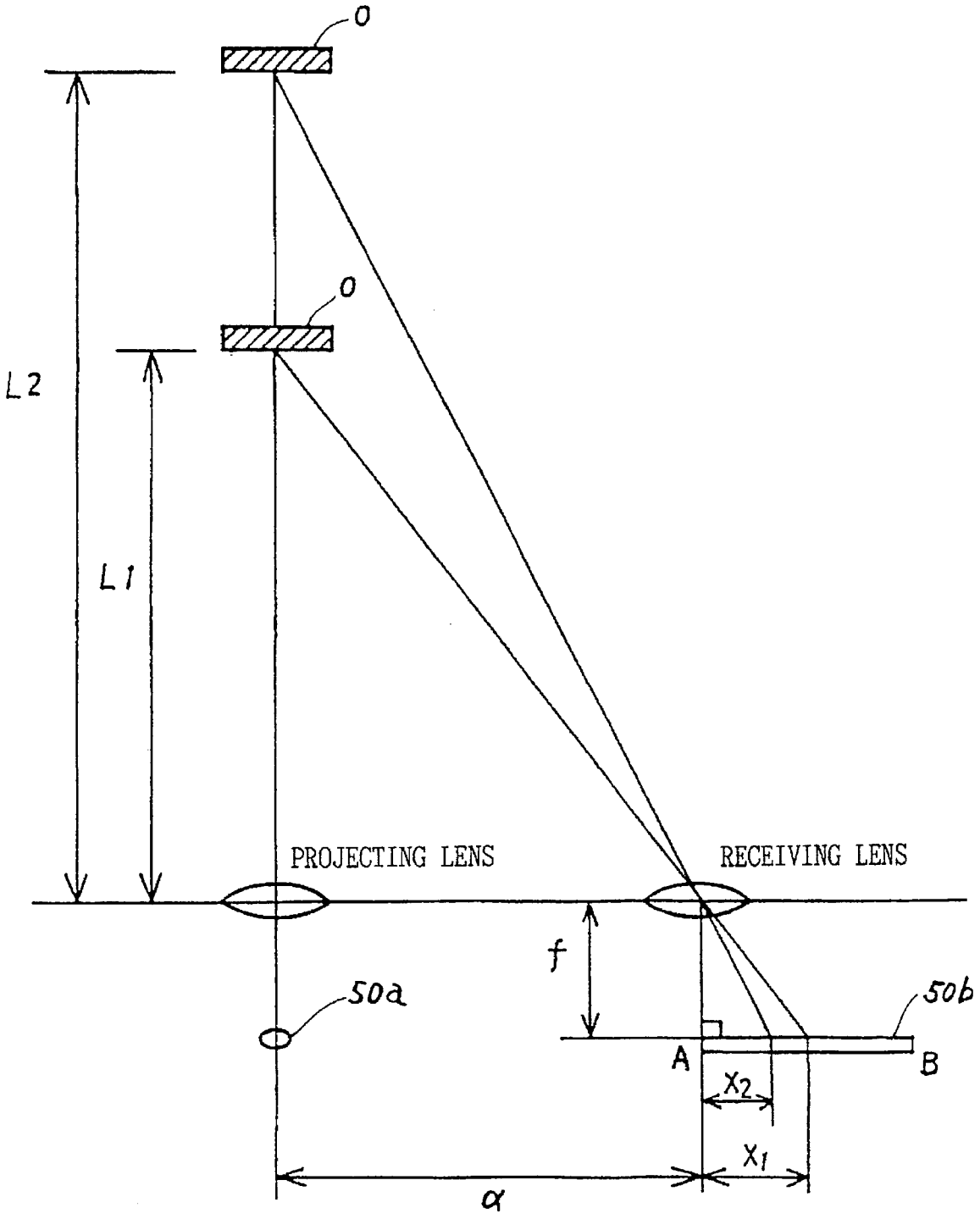
FIG. 9 is a schematic illustration describing the principle of distance measurement related to the invention.

For example, as shown in FIG. 9, an object to be measured (lower surface of document 0 in this embodiment) is illuminated by light from a light emitting element (infrared LED) 50*a*, forming a distance sensor 50 (PSD sensor) to be described later. The resulting reflected light will be received by a light receiving element 50*b* of the PSD sensor (distance measurement sensor) via a light receiving lens. The position x1 of the light receiving point (spot position) at this time is found to be x1=α* f/L1 in the relationship shown in the figure.

In the equation above, α is the distance (fixed) between the centers of the projecting lens and the light receiving lens; L1 is the distance (measurement distance in the invention) from the projecting lens to the object to be measured; and f is the focus distance (fixed) of the light receiving lens. Consequently, the farther the distance of the object to be measured 0 is, for instance L2, the position x1 of the light receiving spot on the light receiving surface of the PSD sensor will move closer to the electrode A side and shift towards position x2. Conversely, if the light receiving spot position x1 is close to the electrode B side, the distance to the object to be measured 0 will become closer.

Then, the spot x of the light receiving surface of the PSD sensor can be specified by the electrical current ratio I1/I2 to be obtained from electrodes A and B as described above. Following the equation above, the distance to the object to be measured 0 from the light emitting element or, in other words, the distance from the object to the PSD sensor (distance measurement sensor) can be measured.

Therefore, in the invention the PSD sensor (distance measurement sensor) is arranged at the position of the sensors 25*a*, 25*b* shown in FIG. 1 and FIG. 2. Further, the drive of the PSD sensor and its output are driven and input by an CPU 41 that controls the drive of the sheet feeding apparatus as shown in the block diagram in FIG. 10. CPU 41 drives the light emitting element 50*a* of the distance measurement sensor 50 to emit light via a driver 42 and, at that time, via an A/D input port (not shown in figure) this CPU 41 inputs an analog signal of a signal processing circuit 43 that converts and processes the electrical current I1 and I2 in response to light receiving points by the light receiving element 50*b*. This operation calculates the distance (L1) from the distance measurement sensor 50 to the lower surface of the document (object to be measured) based on the equation described above. Depending on the measured distance (L1) found by this calculation, the CPU 41 determines the rotation angle and a direction of the stepping motor 34 to drive that drive via a control circuit 44. This action controls the adjustment of the injection quantity of air in response to the open/close position of the shutter valve 33.

Figure 10:
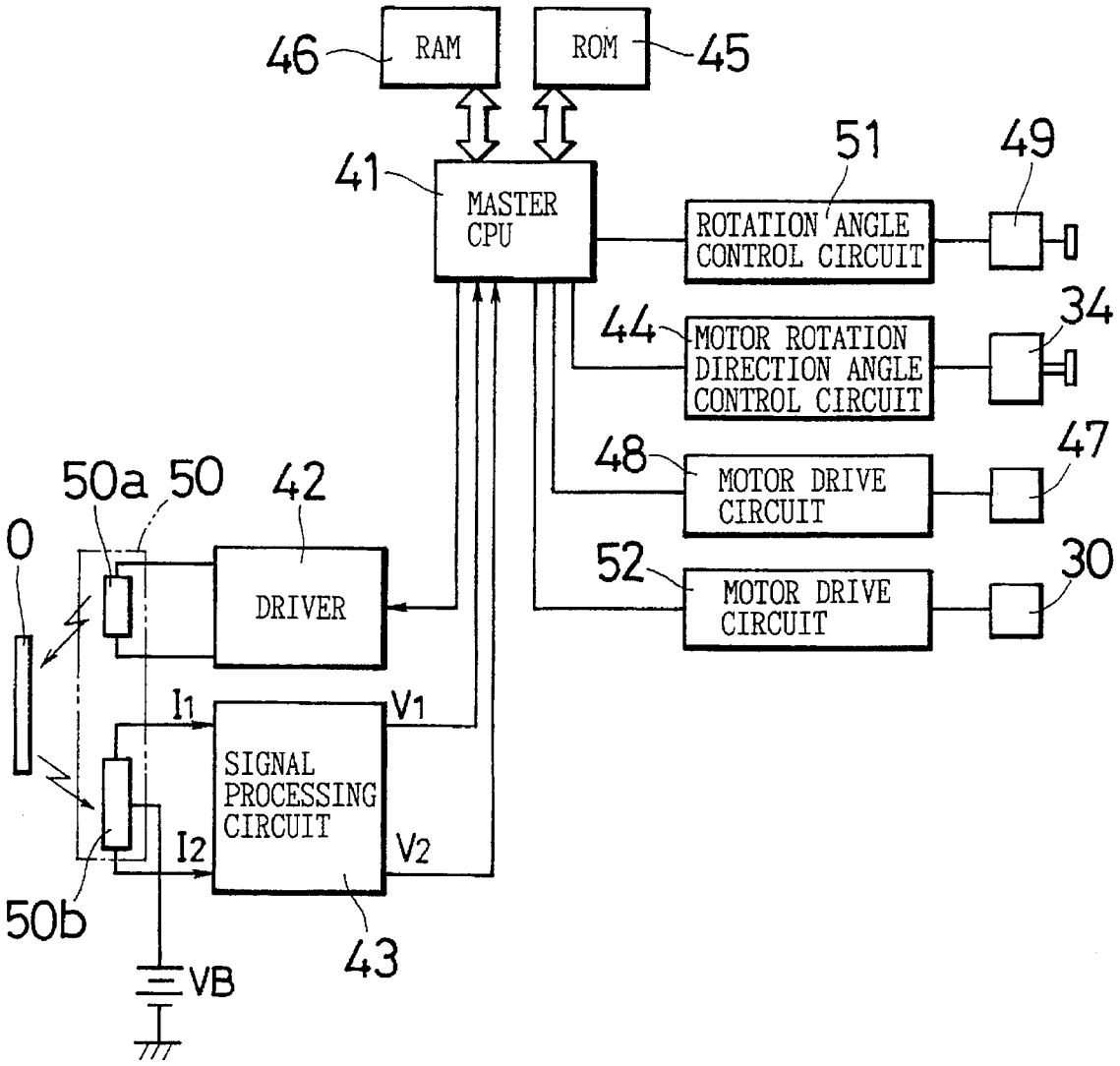
FIG. 10 is a control block diagram that includes control of the sheet feeding apparatus according to the invention as well as control of distance measurement by the measurement sensors.

Furthermore, in FIG. 10 an ROM 45 containing stored control programs and an RAM 46 that stores necessary information related to the control are connected to the CPU 41 with control executed in order following the stored programs in the ROM. Information necessary during the execution of this control is stored in the RAM 46. For example, the measured distance L1 found by the distance measurement sensor 50 is stored in a specified region of the RAM 46.

Further, in addition to the drive of the stepping motor 34 that drives the shutter valve 33 to adjust the injection quantity of air, a drive circuit 48 that drives a driving motor 47 to rotate the suction fan 34 that sucks the lowermost sheet on the sheet feeding belt 23; a drive control circuit 51 that controls the rotation direction and rotation angle of a drive motor 49 that drives the shutter valve (not shown in figure) to adjust the suction amount; and another drive circuit 52 that drives a drive motor 30 to actuate the separation fan 31 that injects air are connected to the CPU 41.

Thereupon, an example of control to adjust the injection quantity of air in response to the distance measured by the distance measurement sensor 50 is described according to the flowchart described in FIG. 4. At first, the motor 30 that drives the separation fan 31 to inject air is driven (step n1) based on the control of the CPU 41. Then, a judgment is made in step N2 on whether or not the motor 30 is set to a fixed speed and, if the motor reaches the fixed speed, the stepping motor 34 starts operation to gradually open the shutter valve 33. Before the operation starts or before the separation fan starts operating, or in other words in the initial state, the distance to the lower document to be stacked (lowermost portion) onto the document tray 13 is measured by the distance measurement sensor 50 and this information is stored in a specified region in the RAM 46 beforehand.

For this distance measurement, by driving the light emitting element by the CPU 41 and receiving the reflected light from the lower surface of the lowermost document by the light receiving element 50*b*, the CFU 41 calculates that distance L. Here, with the document stacked onto the document tray 13 including the sheet feeding belt 23, the distance L to be measured is set to a standard value Ls and stored beforehand. Then, if the distance measured by the distance measurement sensor 50 is equal to the standard value Ls, a judgment can be made as to whether the document to be stacked is flat without curling, wavy or folded states.

In particular, when document sheets are not stacked, light from the light emitting element 50*a* does not illuminate the object to be measured in the distance measurement sensor 50, thus making it impossible to measure distance. In other words, by periodically carrying out measurements with the distance measurement sensor 50, the existence of the document to be stacked can be detected. Thereupon, if there is a difference between the standard value Ls and the measured distance L on the CPU 41 side when the distance is measured by the distance measurement sensor 50, this will result in one portion of the document sheets, in particular the floating sheet at the position opposite to the distance measurement sensor 50 being detected which can be defined as that portion curling, wavy or folded. Moreover, the plural arrangement of distance measurement sensors 50, in this embodiment two being arranged, allows a judgment to made on whether the document sheet is curling or folded in response to the measurement state by each distance measurement sensor 50.

For example, when the measurement result La using the distance measurement sensor 50 disposed at the position of the sensor 25*a* in FIG. 1 is larger than the measurement result Lb using the distance measurement sensor 50 disposed at the position of the sensor 25*b* (La>Lb), curling or waves in the upward direction of the front edge of the document sheet can be detected. Conversely, if La<Lb, curling or waves in the upward direction of the rear edge of the document sheet can be detected.

As stated above, aside from detecting curling using the difference between measurement distance L and the standard value Ls, the air injection is started by n3 and through this, distance measurements are executed periodically using the distance measurement sensor 50 and, if the measurement distance L2 at that time is larger than distance L measured beforehand or, in other words, L2>L, floating of the document sheets can be detected. At that time, a floating state during air injection can be precisely detected by not only a comparison between the standard value Ls but also by a comparison between measurement distance L up to the document sheets when they were stacked.

When a floating state during air injection is detected at this point, the injection quantity of air can be precisely controlled by not judging L2>L but by comparing whether that floating is equal to a floating distance ΔLs determined beforehand. Consequently, if the difference ΔL=L2−L between the measurement result L2 and the previously measured distance L is the floating standard distance Ls, then the injection quantity at that time should be maintained by stopping, the drive of the stepping motor 34 with the result of that position (n5) being maintained. Therefore, a floating state where the document floats to the distance Δ Ls that enable the lowermost document sheet to be sucked by the sheet feeding belt 23 can be maintained. The feeding by one sheet at a time is ensured with even more accuracy.

The ΔLs above is a floating state that allows suction by the sheet feeding belt 23 as stated above. For example, ΔLs is a floating state relative to the standard value Ls. If the injection quantity of air is large, the floating state will exceed ΔLs. In other words, in an air injection state, the difference ΔL between the measurement distance ΔL2 and the previously measured distance L using the distance measurement sensor 50 will exceed the floating distance Ls and in this state, the stepping motor 34 can be controlled in a direction to reduce the injection quantity of air. If sheets for photocopying and not documents are stacked and then gradually fed, the stacked quantity of sheets will gradually reduce and the injection quantity of air being maintained will become excessive, resulting in the floating of the sheets exceeding the determined position. This type of state can be eliminated.

In the above description, the floating state of the document sheet can be detected in the setling of the injection quantity of air by the difference between distance L initially measured beforehand using the distance measurement sensor 50 and measured distance L2 after the air injection starts. Consequently, detection of a floating state can be done with high accuracy compared to a microswitch, thus allowing precise and reliable detection. In effect, because the floating slate due to air injection can be precisely and promptly detected regardless of curling of the document sheets, the injection quantity of air can be maintained in that state. A further advantage is that the time for the injection quantity of air control to maintain the floating in a correct state can be shortened because while not being necessary to gradually increase the injection quantity of air, setting the injection quantity of air to a predetermined quantity beforehand to detect the floating state of a document makes it possible to freely control the increase and decrease direction of that injection quantity of air.

Also, in order to feed one sheet at a time with even more reliability, an interval the document floats from the stacked position of the document sheets is needed or, in other words, ΔLs must always be maintained at a prescribed state. Therefore, using a mechanical device such as a microswitch, even if the state where the difference ΔL is greather than ΔLs can be detected, maintaining ΔLs is extremely difficult because of the characteristics of the mechanical microswitch described above. On the other hand, with the distance measurement sensor 50, because the actual floating state can be precisely measured as a distance, the open/close position of the shutter valve 33 can be adjusted to control the injection quantity of air so that the difference ΔLs in measurement becomes the determined ΔLs. In particular, if there is a change in the floating state of the document sheets during the feeding operation, the CPU 41 interprets this as a change in the distance thus, controlling the injection quantity of air. Thereby, the rotation direction of the stepping motor 34 that opens and closes the shutter valve 33 to adjust the injection quantity of air is controlled and the floating state is maintained such that the difference ΔL remains within the range of ΔLs predetermined.

In the distance measurement above, the drive motor 49 is driven to control the suction of the suction fan 24 at the sheet feeding belt 23 side to feed the sheets. After the sheet is fed, the shutter value is closed to stop the suction state. At this time, the distance is measured by the distance measurement sensor 50. After the rear edge of the fed sheet has passed the position of the distance measurement sensor 50, this distance measurement is conducted.

Here, the distance measurement sensor 50 can be utilized as a sensor to detect whether the lowermost sheet to be fed is being sucked on the sheet feed belt 23 side. In other words, when the sheet feeding operation starts, the lowermost sheet will be sucked to the sheet feed belt 23 side by air suction force. The distance is measured by the distance measurement sensor 50 after this suction. The suction action can be confirmed when this measured distance L1 and the distance L measured before the above floating control are almost equal. However, there is a possibility that the distance L stated above may be almost equal to the standard value Ls and L is larger than Ls, a curling state when loading sheets can be confirmed. Also, the suction state can be confirmed when the measured distance L1 is almost equal to the standard value Ls.

As indicated before, with a state in which the sheet feeding apparatus is assembled, flat sheets are stacked and the distance to the stacked sheets on the sheet feeding belt 23 is measured by the distance measurement sensor 50 beforehand and this is set as the standard value Ls. This standard value Ls is the inherent part of the sheet feeding apparatus and is determined by the distance from the distance measurement sensor 50 to the stacked sheets without regard to the arranged position of the distance measurement sensor 50. Consequently, adjustments to the arranged position of the distance measurement sensor 50 are not required. Nor is severe arrangement precision of the distance measurement sensor 50 necessary.

The distance measurement sensor 50 can detect whether the lowermost sheet is being sucked to the sheet feeding belt 23 during the feed and if the suction is not being reliably done ($L_1$>Ls), either the rotating speed of the suction fan 24 can be increased or the suction force by adjusting the opening angle of the shutter valve can be controlled. If the distance measurement is carried out by the distance measurement sensor 50 after the feed operation has started and a fixed time has elapsed and the sheet suction is not confirmed, a control operation is carried out to increase the suction force in stages. This action can prevent poor feeds before they occur.

When the sheet is sucked to the sheet feeding belt 23, the rpm of the suction fan 24 is either previously set to a state in which the sheet can be sucked in the floating state described above or previously determined by the opening angle of the shutter valve. These are set to allow the sheet to be reliably sucked to the sheet feeding belt 23 in the initial setting. However, it may become impossible to obtain the specified suction force in the previous setting state due to changes with the passing of time or other reasons. In this case, increases to the suction force can be controlled by detecting the suction state described above with the distance measurement sensor 50. This suction force control is operated in a state set beforehand during the initial period to start the feeding operation and if the suction force is found to be insufficient, control to increase the suction force can be carried out. Then at the step when one ream of sheets has completed the feed, that suction force is returned to the previously set state.

The confirmation of the suction state during the feed is not limited to the distance measurement sensor 50, but can also be done in a like manner using the sensors 25*a*, 25*b* with a microswitch or with the optical sensor 250. In other words, when the floating sheet is sucked to the sheet feeding belt 23, that switch state will become equal to the stacked document state, thus allowing the suction state to be detected. For example, by changing the sensors 25*a*, 25*b* from an OFF state (floating detection) to an ON state (loading detection), the response to that change will allow the detection of the suction state. Then, if the suction state cannot be detected even with the fixed time, control to increase the suction force can be carried out. However, because when one among the floating sensor 25*a*, 25*b* and the optical sensor 250 is used, the control to increase the suction force cannot reliably confirm the floating state as a distance unlike with the distance measurement sensor 50, the accuracy drops but since the suction state can be detected, like results can be expected.

As described above, by using the distance measurement sensor 50, the actual floating state of the document sheet can be precisely detected and the injection quantity of air can be adjusted in response to that floating state thus making it possible to maintain the sheet at a determined floating position by the use of that injection quantity. Therefore, one sheet of paper can be accurately fed.

Further, by providing a plurality of distance measurement sensors 50, curling and waves in the document sheets can be detected in response to each detection state by the sensors 25*a*, 25*b* using a microswitch as described. In this connection, according to the distance measurement sensor, curling and waves in the sheets can be detected with only one sensor and, by providing a plurality of sensors, a judgment can be made on the direction and state of the curling and waves as well as the degree of the curling in response to the measured distance. Further, in response to these judged states the injection quantity of air can be controlled. For example, if there is curling of the front edge of the sheet in the upper direction, that injection quantity can be adjusted to be controlled less and, conversely, that injection quantity can also be adjusted to be controlled more. This is identical to the process with the floating sensors 25*a*, 25*b* using a microswitch.

<Example 2>

The second embodiment of the invention is described.

In this embodiment the injection quantity of air is controlled in response to the relationship between the floating state of the document before the start of air injection from the separation air injection unit 3 and the floating state of the document after the start of air injection. Thereby, the relationship between the floating state (ON/OFF state of floating sensors 25*a*, 25*b*) of the document before and after the start of air injection and the injection quantity of air is stored in the memory of the separation air injection unit, the sheet feeding apparatus or the copying machine and, based on this relationship, the injection quantity of air can be determined. The above relationship is stored in a table format. FIG. 11 shows an exemplification of this relationship.

As shown in the figure, based on the state when the documents are set, or namely, the relationship between the ON/OFF state of the floating sensors 25*a*, 25*b* when no air is injected and the ON/OFF state of floating sensors 25*a*, 25*b* after the air injection has started, the injection quantity of air is set. The injection quantity of air is represented by the open/close state of the shutter valve 33. A concrete example of setting the injection quantity of air is shown.

(1) The floating sensors 25*a*, 25*b* are OFF/OFF when the documents are set.

Regardless of the detection state of the floating sensors 25*a*, 25*b* after air injection, the injection quantity of air will be held at the low state previously determined (open state of the shutter valve set from a few % to a few tens %). This means both floating sensors 25*a*, 25*b* are OFF with the document in a set state and it shows that there are hardly any documents, or the documents are light, or that there are folds in the documents and the documents are floating. Therefore, it is considered for this case that even if the injection quantity of air is extremely small, duplicate feeds can be sufficiently prevented and the injection quantity of air can be held at the minimum.

(2) The floating sensors 25*a*, 25*b* are ON/ON when the documents are set.

Since this is a state in which there are many documents with a heavy weight, it is necessary to sufficiently increase the injection quantity of air until the documents float in order to prevent duplicate feeds. Therefore, a target value of the injection quantity of air for this case is set to the largest possible value (shutter valve open 100%). However, if at least one of the floating sensors 25*a*, 25*b* are OFF, the injection quantity of air at that time will be held. If neither of the floating sensors 25*a*, 25*b* turns OFF, the maximum injection quantity of air will be blown.

(3) The downstream sensor 25*a* is OFF and the upstream sensor 25*b* is ON when the documents are set.

The front edge of the document is considered to be in a curling state in the upward direction. When the front edge of the document is curling in the upward direction, duplicate feeds will not occur and the document will be able to be fed comparatively easy, thereby holding the target value of the injection quantity of air at an average intermediate value (shutter value approximately 50% open state). However, if the upstream floating sensor 25*b* turns OFF, the injection quantity of air at that time will be set to an optimum injection quantity of air.

(4) The downstream sensor 25*a* is ON and the upstream sensor 25*b* is OFF when the documents are set.

The front edge of the document is considered to be in a curling state in the downward direction. When the front edge of the document is curling in the downward direction, it will become easier for the document to become entangled, making it impossible to feed the document smoothly. Consequently, the target value of the injection quantity of air will be set to the maximum value (shutter value 100% open state), thus sufficiently floating the document. However, if the downstream floating sensor 25*a* turns OFF, the injection quantity of air at that time will be set as an optimum value.

As described above, the injection quantity of air to be set in response to the state of the floating sensors 25*a*, 25*b* while the documents are set and the state of the floating sensors 25*a*, 25*b* after air injection starts is stored as a table.

Figure 12:
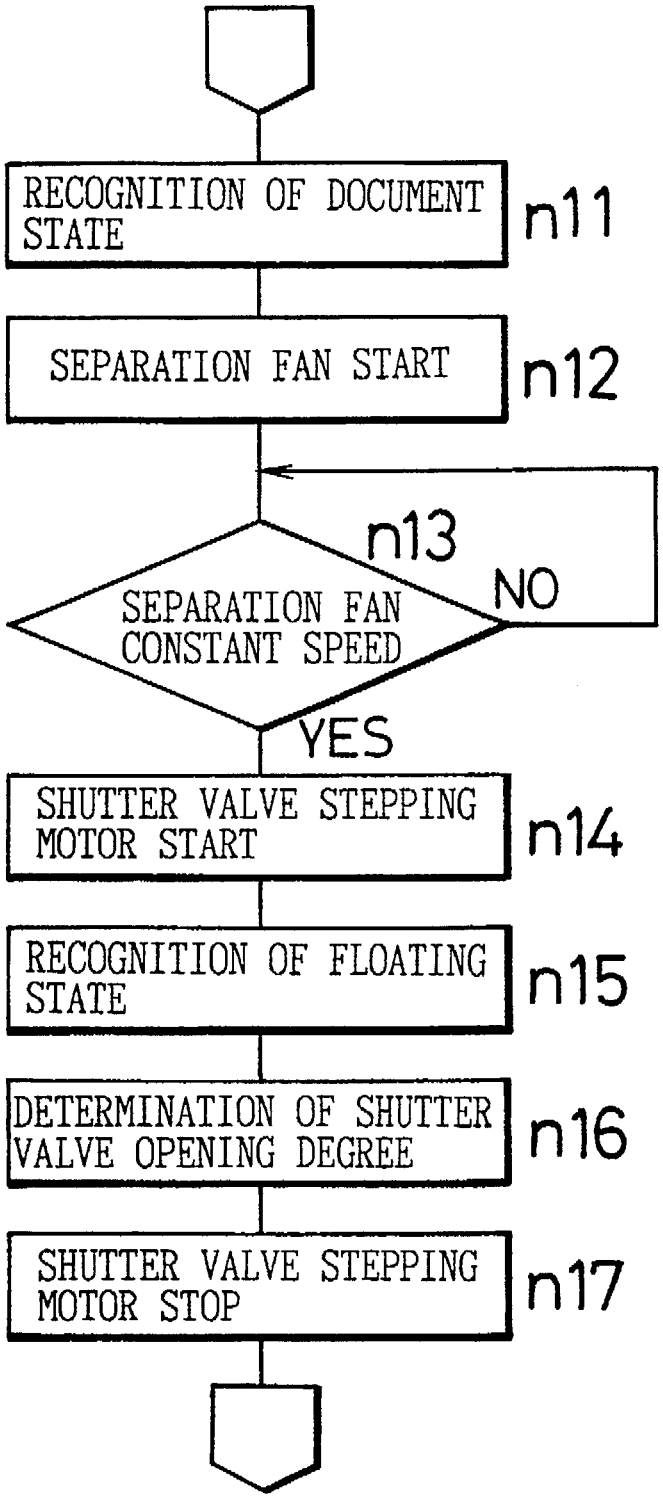
FIG. 12 is a flowchart showing a process related to a second embodiment of the invention.

The processing procedure during the feed is described. FIG. 12 is a flowchart showing this processing procedure.

When the execution timing of the document feed is set by the action of the print switch or the like, at first, the state of the floating sensors 25*a*, 25*b* is detected and that state is stored (n11). Then, the separation fan 31 turns on and after reaching a sufficient rotation speed, the shutter valve 33 opens and injection of air to the front edge of the document bundle starts (n12→n13). Then, while detecting the state of the floating sensors 25*a*, 25*b*, the injection quantity of air, namely, the amount the shutter valve is opened or closed is controlled, based on the table shown in FIG. 11 (n15→n16→n17).

In detail, the initial stacked state on the document tray 13 is detected by the floating sensors 25*a*, 25*b* and if that state indicates both sensors OFF, the shutter valve 33 is opened to a predetermined angle and the stepping motor 34 is rotated and stopped at a position corresponding to that open angle (n17).

Further, if the each detection states of the document stacking by the floating sensors 25*a*, 25*b* turns out to be both ON, a floating state will be confirmed using the sensors 25*a*, 25*b* in step n15 and if the floating sensors 25*a*, 25*b* detect a change in the detection state while the shutter valve 33 is fully open, the drive of the stepping motor 34 will be stopped at that time. Alternatively, if the floating state changes in n15, the drive of the stepping motor 34 will be maintained and rotated in the fully open direction and if floating is not detected when fully open, the fully open state will be maintained and the drive of the stepping motor 34 will be stopped.

Next, if each detection state of the document stacking by the floating sensor 25*a*, 25*b* turns out to be OFF and ON, respectively, the shutter valve will start to open until it is halfway open to set an injection quantity of 50% relative to the maximum injection quantity of air and the drive of the stepping motor 34 will be stopped to hold that injection quantity by the floating sensor 25*b* changing to OFF during that opening operation. However, if there is no change in the OFF state of the floating sensor 25*b*, the drive of the stepping motor 34 will be stopped at the state in which 50% of the maximum injection quantity of air is held as described above.

Furthermore, if each detection state of the document stacking by the sensors 25*a*, 25*b* turns out to be ON and OFF, respectively, the sensors 25*a*, 25*b* will both turn OFF, or in other words, the drive of the stepping motor 34 will be stopped to hold the injection quantity of air at the moment floating of the document is detected while the rotating drive of the stepping motor 34 is supplying the maximum injection quantity of air. However, when both floating sensors 25*a*, 25*b* do not turn OFF as described above, the drive of the stepping motor 34 will stop if the shutter valve reaches a fully open state to supply the maximum injection quantity.

As stated above, the state of the document bundle or documents to be stacked in the document tray 13, for example, curling or the like can be detected and in response to this, the injection quantity of air can be controlled. Thus, the sheet can be floated and fed by means of the necessary injection quantity. This action not only allows the feeding operation to be stabilized, but also makes the operation of controlling the injection quantity easier.

For the above sensors 25*a*, 25*b*, not only microswitches can be used but also the optical sensor 250 or distance measurement sensor 50 can be used in the same way. Compared to a sensor using a microswitch, no differences in the operating position that changes ON→OFF or OFF→ON allow the latter sensors to provide higher precision control. In effect, because a microswitch accompany a change with a large stroke in the operation change described above, even though the document is actually floating, it is not detected, although a changing state with a large vertical movement can be detected. In view of this, since an optical sensor or distance measurement sensor allow more detection of small changes in vertical movement compared to a microswitch, the injection quantity of air can be controlled with more precision.

Further, arranging a plurality of sensors becomes important to detect curling of the sheets as well as other states. Therefore, in addition to controlling the injection quantity of air by detecting a floating state with a sensor as described in Example 1, according to Example 2, the injection quantity of air could be further controlled in response to curling of the sheets as well as other states. Thereby, setting wasteful injection quantities of air is eliminated and the injection quantity of air can be adjusted in response to the sheet state, thus making it possible to expect even more effects.

In particular, with the distance measurement sensor 50, not only can curling of the sheets as well as other states be detected, but also the level of difference in that curling can also be detected. Thereby, if the curling is large, the injection quantity can be controlled accordingly. For example, if distance measured La using the distance measurement sensor (at the position of the floating sensor 25*a* in FIG. 1) at the front edge of the sheet feeding direction is larger than distance measured Lb using the distance measurement sensor (at the position of the floating sensor 25*b* in FIG. 1) at the rear edge of the sheet feeding direction (La>Lb), the curl will be an upward curling and in response to the difference between La at that time and the previously described standard value Ls, the degree of curling of that curl can be judged. If that curl is large, the injection quantity of air will be set smaller compared to a small curl. In this case, the injection quantity can be set less than a 50% setting of the injection quantity of air.

<Example 3>

The third embodiment of the invention is described.

Figure 13:
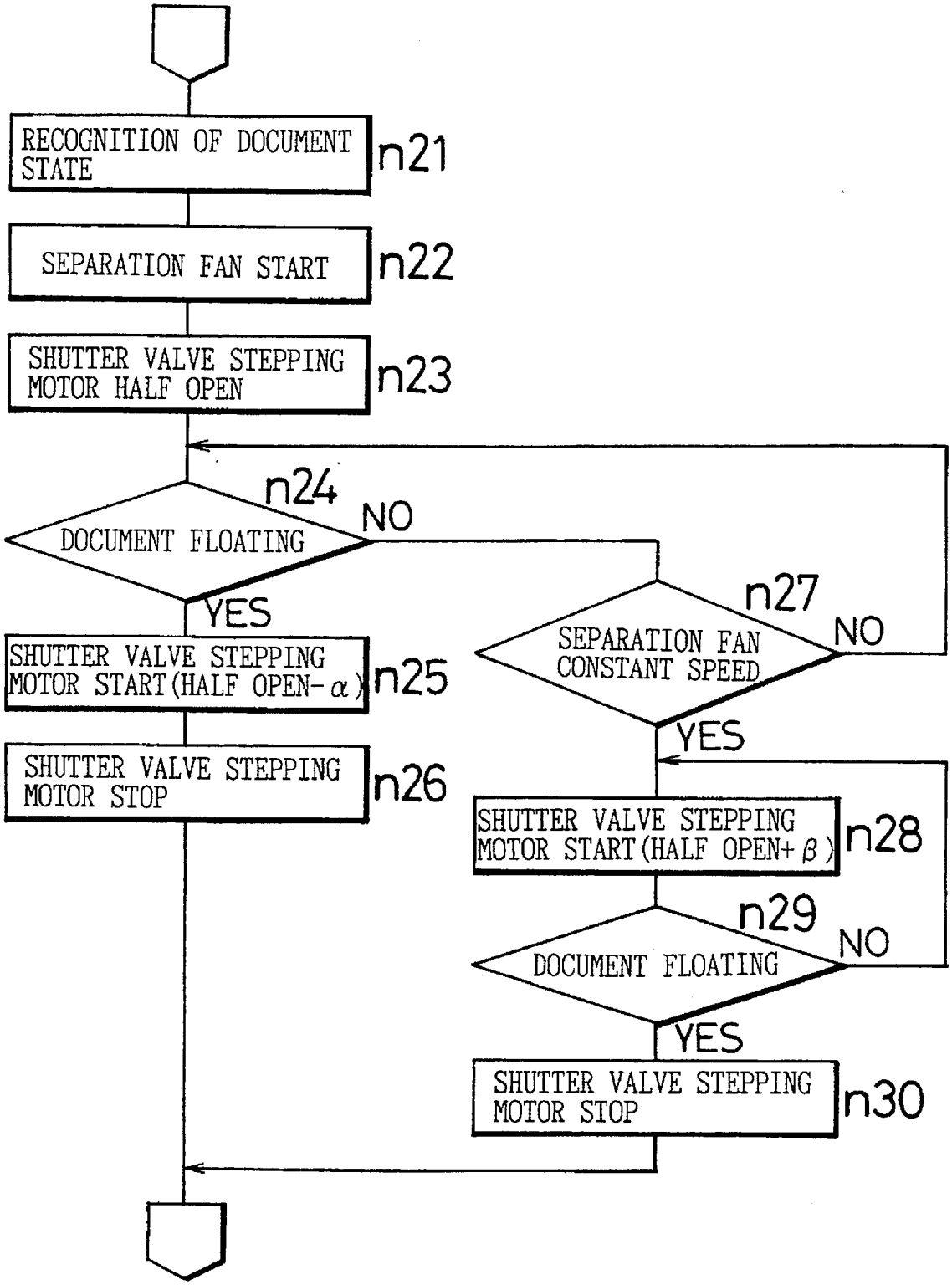
FIG. 13 is a flowchart showing the process related to a third embodiment of the invention.

In Examples 1 and 2, the shutter valve 33 opens after the rotation of the separation fan 31 reaches a sufficient degree and then the air is injected. In this example, the shutter valve 33 opens without waiting for the sufficient startup of the separation fan 31 and then the injection of air against the document bundle starts. FIG. 13 is a flowchart showing the processing procedure for this case.

While the sheet is being fed, at first, the state of the floating sensors 25*a*, 25*b* is detected and that state is stored (n21). Then, the separation fan 31 turns ON and simultaneously the stepping motor 34 is actuated, opening the shutter valve 33 to a half open state (n22→n23). For example, if the stepping motor 34 is in a fully open state in 40 steps, then it will open in only 20 steps. When the shutter valve 33 is opened halfway in this manner, the rotation of the separation fan 31 will start accompanied by a gradual increase in the air pressure being blown to the document bundle.

At this point, when the documents being stacked in the document tray 13 are either lightweight, there are only a few documents or the front edge is curling upward, there is a possibility the documents will float even if the separation fan has not sufficiently rotated or a possibility the detection state of the floating sensors 25*a*, 25*b* may change. That is, before the separation fan 31 reaches a constant speed in n27, there is a possibility that a change in the floating sensors 25*a*, 25*b* may be detected in n24. In this case, if the separation fan 31 rotates even more, the injection quantity of air will become too much or in other words, a problem will occur in which the air pressure becomes too high. Consequently, the shutter valve 33 must be returned to a certain extent in order to obtain an optimum air injection pressure when the separation fan 31 is completely started. The particular method is described below.

The startup characteristics of the air injection pressure when the separation fan 31 starts are shown in FIG. 15. The air injection pressure when the open state of the shutter valve 33 changes is shown in the figure. Further, the pressure when the separation fan 31 starts with the shutter valve 33 fully closed is the pressure inside the separation fan 31 housing unit. The pressure when the separation fan 31 starts with the shutter valve 33 half open and fully open shows the injection pressure of the actual air. The pressure during air injection when the shutter valve 33 is fully closed is almost 0 (app. 0.9 mmAq).

Using this figure, the air injection pressure required to float the sheet even when the floating sensors 25*a*, 25*b* operate while the separation fan 31 starts with the shutter valve 33 in a half open state can be determined. For example, 1100 msec after the separation fan 31 starts, at least one of the floating sensors 25*a*, 25*b* may detect a change. When this occurs, a necessary air injection quantity of 9.9 mmAq can be read from FIG. 15.

In contrast, FIG. 17 shows the relationship between the injection pressure of air in a state in which the separation fan 31 has completely started and the state of the shutter valve 33 being open. Based on this figure, the open/close state of the shutter valve 33 that can provide the injection pressure of air of 9.9 mmAq stated above, or in other words, the number of steps of the stepping motor 34, is obtained. In this example, the necessary number of steps is between 15 and 16 steps and the large number of 16 steps is set as the number of steps for the necessary open/close state. If this is set to the small number of 15 steps, there is a possibility that the injection pressure of air will be insufficient. By setting the number of steps obtained this way to the stepping motor 34, the shutter valve 33 can be set to an optimum open state when the separation fan 31 sufficiently starts. Therefore, by storing the tables shown in FIG. 15 and FIG. 17 in memory beforehand, an optimum open degree of the shutter valve can be obtained.

In this way, when the detection state of the floating sensors 25*a*, 25*b* changes before the separation fan 31 starts completely, optimum open degree of the shutter valve 33 is obtained and the open degree of the shutter valve 33 is adjusted by the stepping motor 34 (to half-open−α) (n24→n25→n26).

Conversely, when the separation fan 31 starts completely without any change in the state of the floating sensors 25*a*, 25*b*, while the detection state of the floating sensors 25*a*, 25*b* is being judged, the shutter valve 33 is set to open gradually (to half-open+α) (n27→n28→n29). Then, identical to Example 2, if the detection state of the floating sensors 25*a*, 25*b* changes, the shutter valve 33 will stop at that position and after that air will continue to be injected at that open degree (n30). When there is no change in the detection state of the floating sensors 25*a*, 25*b* even though the shutter valve 33 is fully opened, the shutter valve 33 will be held in the fully open state.

When this example is executed in this way, the document can be floated before the rotation of the separation fan 31 reaches a full degree, depending on the number of sheets in the document bundle or the type of documents, thus allowing the feeding of the document to be quickly carried out.

Figure 14:
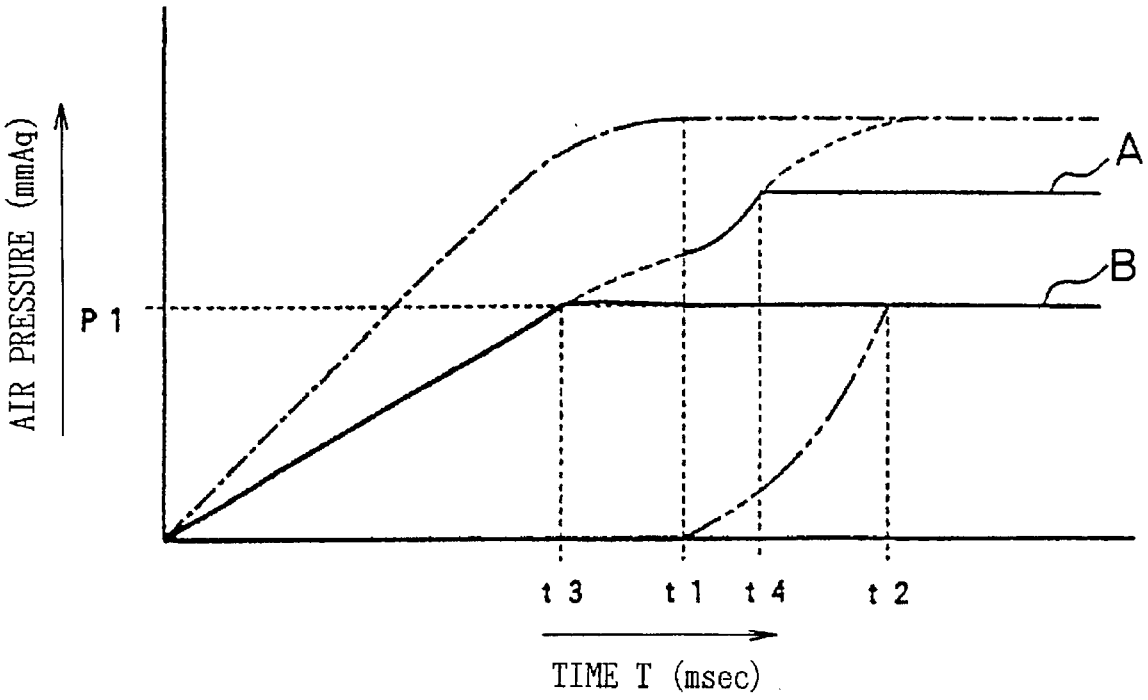
FIG. 14 is a view showing an example of changes to the injection quantity of air pressure when the process of FIG. 13 is carried out.

FIG. 14 shows changes in the air injection pressure while the air is being injected. In the figure, the rotation of the separation fan 31 reaches a specified speed by t1. The alternate long and short dash line in the figure shows the pressure at which the shutter valve 33 is fully open. "B" shows an example where the floating sensors 25*a*, 25*b* change before t1 and "A" shows an example where the floating sensors 25*a*, 25*b* change after t1. The alternate long and two short dash line shows the pressure change for Example 1. In order to obtain the pressure of P1 in control example 1, time t2 was required. In this example, the pressure of F1 can be obtained in time t3 thus, it is found that sheets can be quickly fed.

Figure 16:
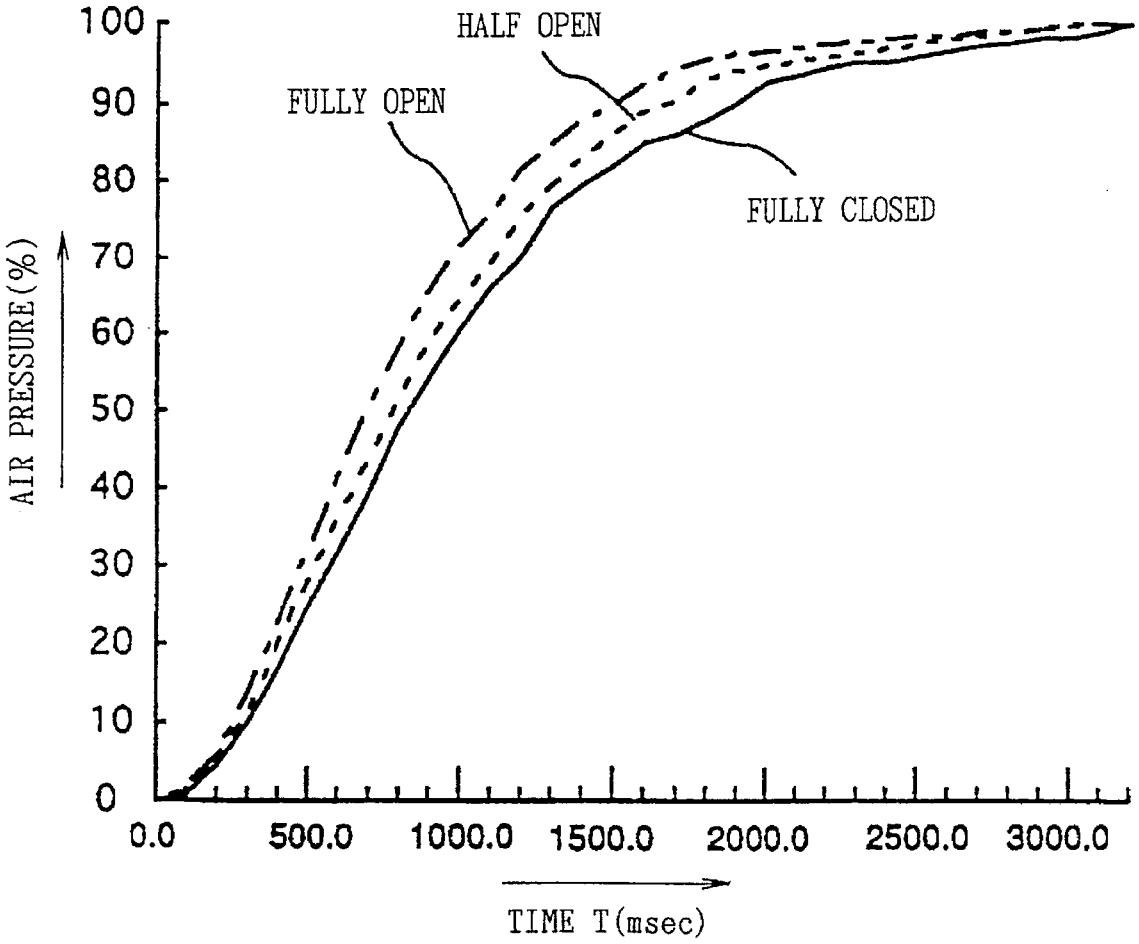
FIG. 16 is a view showing a graphic representation of the table in FIG. 15.

Furthermore, FIG. 16 shows three patterns of open degree (fully open, half open and fully closed) the shutter valve 33 as well as the startup state of the pressure of the separation fan 31. As can be seen from this figure, the shutter valve 33 starts up faster in a half open or fully open state than when it is in a fully closed state. Consequently, compared to the fully closed state shown in Example 1, the half open state of this example can improve the first copy speed of a copying machine even more.

<Example 4>

The fourth embodiment of the invention is described below.

Figure 19:
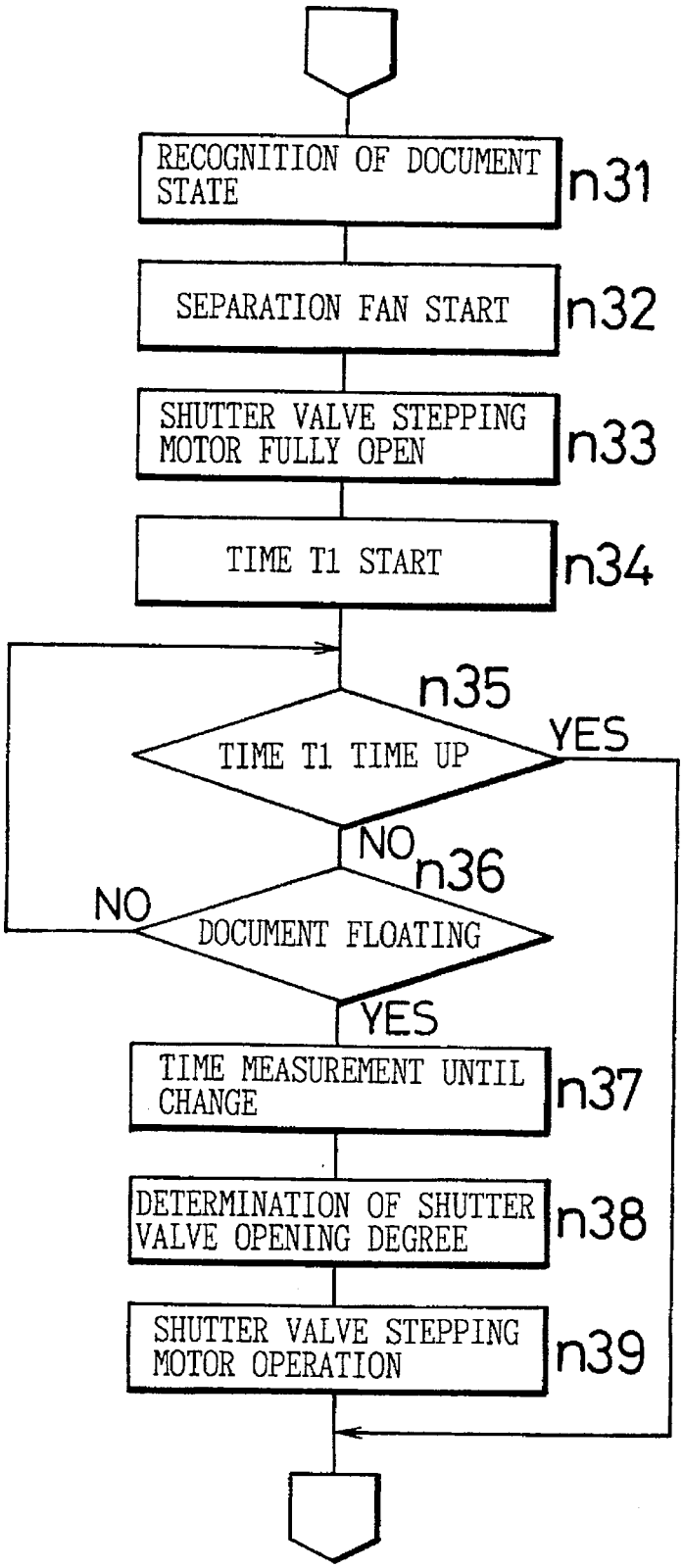
FIG. 19 is a flowchart showing a process related to a fourth embodiment of the invention.

In this example, the shutter valve 33 fully opens at the same time the separation fan 31 turns ON and the separation fan 31 starts up while the air is being injected to the document. If the document is found to be floating by the floating sensors 25*a*, 25*b* during this time, the opening degree of the shutter valve 33 is determined in response to the time from when the separation fan 31 turns ON. FIG. 19 is a flowchart showing the processing procedure for this example.

While the sheet is being fed, at first, the state of the floating sensors 25*a*, 25*b* is detected (n31). Then, the shutter valve 33 fully opens at the same time the separation fan 31 turns ON (n32→n33). Next, while the predetermined time T1 (described later) is measured by a timer, any change state of the floating sensors 25*a*, 25*b* is detected (n34→n35→n36). If there is a change in the state of the floating sensors 25*a*, 25*b* while timer T1 is counting, the time required until the floating sensors 25*a*, 25*b* change after the separation fan 31 turns ON is obtained and, in response to that, the opening degree of the shutter valve 33 is set (n37→n38→n39). In contrast, if there is no change in the state of the floating sensors 25*a*, 25*b* until timer T1 has completed counting (time-up), the shutter valve 33 will remain fully open.

The time counted by timer T1 is the time required for the separation fan 31 to increase the air pressure (nearly equal to the injection quantity of air) until an output rate that may be considered about 100% is attained. The actual output rate is from 80% to 90% or more. If the document bundle does not float even though air is injected at an output rate from 80% to 90% or more, there is no possibility of excessive blowing even if the air is injected at 100%. Referring to FIG. 15, the output rate exceeding 80% or more in a fully open state occurs after 1200 msec. For instance, the count time by the timer T1 is set to 1200 msec. When this time is set, after the separation fan 31 turns ON, it will be determined that the shutter valve is fully open in 1200 msec, thus allowing the feeding process to start immediately after that.

Figure 18:
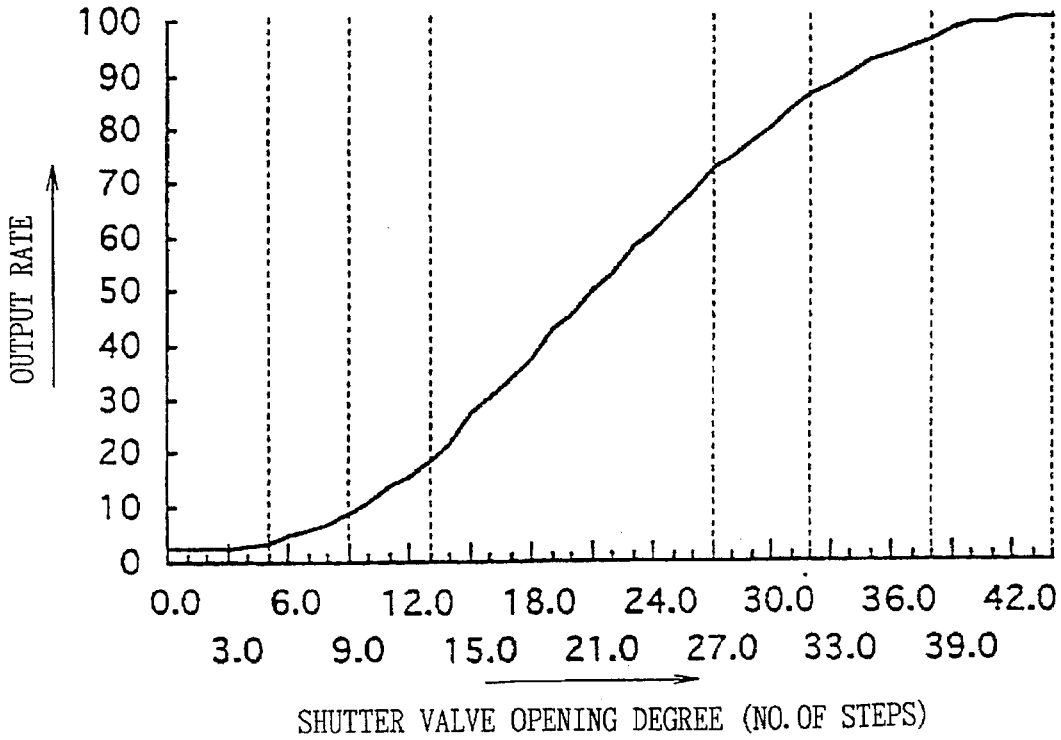
FIG. 18 is a graphic representation of the table of FIG. 17 and shows approximate expressions between the injection quantity of air pressure and the number of open/close steps of the shutter valve.

In this example, the sheet feeding can be started at the 1200 msec point without waiting until the separation fan starts completely (about 3100 msec). Because of this, the first copy time can be shortened. The count time of timer T1 sets the separation fan 31 to an optimum value from between 1200 msec to 3100 msec. Further, in order to obtain the opening degree of the shutter valve 33, the necessary air injection pressure (mmAq) is obtained by referring to FIG. 15 based on the time until the floating sensors 25*a*, 25*b* change in a manner similar to Example 3. Then, based on FIG. 17, the optimum number of steps of the stepping motor 34 are obtained. FIG. 18 shows a graphic representation of the table in FIG. 17 showing approximate expressions between the injection quantity of air and the shutter valve number of steps.

FIG. 15 shows the air pressure every 100 msec. This time unit can be set suitably, for example, if the setting is every 50 msec, a finer control is possible. In this case, it is preferable to make the number of steps of the stepping motor 34 finer also.

<Example 5>

The fifth embodiment of the invention is described below.

In this example, identical to Example 4, the separation fan 31 starts up while the shutter valve 33 fully opens beforehand to inject air. And further, when the detection state of the floating sensors 25*a*, 25*b* changes, the period (rpm) of the separation fan 31 at that time will be detected and in response to that rpm, the opening degree of the shutter valve 33 will be set.

Figure 20:
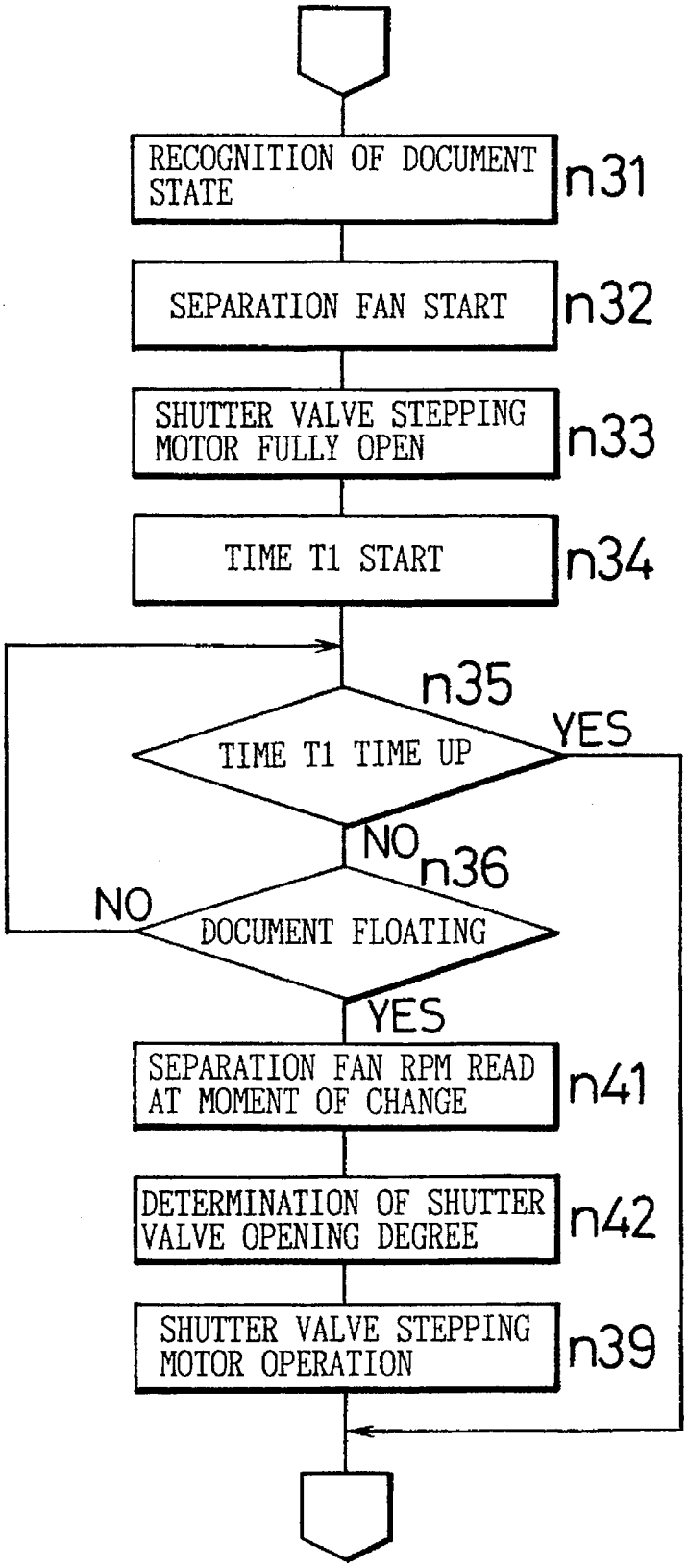
FIG. 20 is a flowchart showing a process related to a fifth embodiment of the invention.

FIG. 21 shows the relationship between the separation fan 31 and the air pressure. If the rpm of the separation fan 31 increases, the air pressure will rise also. Here, with the shutter valve 33 in a fully open state, the detection state of the floating sensors 25*a*, 25*b* will change when the separation fan 31 reaches a certain rpm. The air pressure at that time when it happens is easy to determine based on FIG. 21 with that air pressure becoming the necessary air pressure. Conversely, if the necessary air pressure is given, the opening degree of the shutter valve 33 (number of steps of the stepping motor 34) can be obtained based on FIG. 17. Therefore, if the period of the separation fan 31 when the detection state of the floating sensors 25*a*, 25*b* changes is detected, the opening degree of the shutter valve 33 can be set. FIG. 20 is a flowchart showing the processing procedure for this example.

In this processing procedure, n31' to n36' and n39' are the same steps as those appearing in FIG. 19. If the separation fan 31 turns ON with the shutter valve 33 in a fully open state and then the detection state of the floating sensors 25*a*, 25*b* changes before the timer T indicates time-up, the opening degree of the shutter valve 33 will be set again to a suitable value. However, at that time, the opening degree of the shutter valve 33 (number of steps of the stepping motor 34) will be set based on the period of the separation fan 31 when the detection state of the floating sensors 25*a*, 25*b* changes. (n41→n42).

When the opening degree of the shutter valve 33 is set based on the rpm of the separation fan 31 in this way, for example, when the feeding process continues to a certain degree, precise control is possible even if the next process starts before the separation fan 31 does not stop completely. Namely, in Example 4, the opening degree of the shutter valve 33 will be set based on the time until the detection state of the floating sensors 25*a*, 25*b* changes after the separation fan turns ON, although if inertia causes the fan to rotate before the separation fan 31 turns ON, there is a possibility that precise control based on the above time will not be possible. In this example, precise control is possible even for such a case.

(iii) Error Correction

In the sheet feeding apparatus constructed as described above, there is a possibility of variations in the injection quantity of air from one sheet feeding apparatus to another even if the same air injection control is executed due to variations in the performance of the separation fan 31, variations in the opening degree of the shutter valve 33 or variations in the assembly accuracy of the sheet feeding apparatus. The initial waiting position (origin point) of the shutter valve 33 is corrected here to correct for variations in the injection quantity of air described above.

The separation fan 31 of the sheet feeding apparatus will change its rpm by virtue of the influence of the open/close state of the shutter valve 33. Namely, because the air does not flow in an airtight state, resistance is minimal and the rpm increases. When the shutter valve opens, the air flows and the rpm decreases. FIG. 22 shows the relationship between the period when the shutter valve is fully open and the period when the shutter valve is fully closed. As shown in the figure, when the shutter valve is set fully open, the period becomes longer. Here, the values "period when fully closed/period when fully open" are theoretically constant values. However, because there are variations in the performance of the separation fan 31 or variations in the opening degree of the shutter valve 33 as described above, there is a possibility that the actual values will not be constant and thus, the injection quantity of air will vary.

Thereupon, at first, the rotation amount (%) of the separation fan of each sheet feeding apparatus is found with the next equation.

$$\begin{aligned} \text{Rotation amount} &= (T_0/T_{44})^2/(T_{0AVG}/T_{44AVG})^2 \times 100 \quad (1) \\ &= (T_0/T_{44})^2/(2.60/3.06)^2 \times 100 \\ &= (T_0/T_{44})^2/0.72 \end{aligned}$$

wherein $T_O$: Period when fully closed; $T_{44}$: Period when fully open; $T_{OAVG}$: Average period when fully closed (2.60 from FIG. 22); and $T_{44AVG}$: Average period when fully open (3.06 from FIG. 22)

This rotation amount corresponds to the injection quantity of air (output rate of air pressure). Thus, the injection quantity of air varies in correspondence with the rotation amount. This rotation amount is made to correspond to the injection quantity of air and, based on that, an optimum shutter valve opening degree can be obtained. FIG. 18 shows the results expressed by the approximate expressions between the opening degree of the shutter valve 33 and the injection quantity of air and the amount of rotation is given "P". Because the above rotation amount indicates the state when the shutter valve 33 is fully open, it applies to the approximate expression for fully open (number of steps 44).

The number of steps X=(rotation amount ($P_{44}$)−78)/0.5 . . . (2)

The number of steps X obtained here represents the level if the air pressure being currently injected is converted to a number of steps. Therefore, the number of steps needed to obtain an air quantity of a normal fully open state can be obtained by correcting to: The number of corrected steps Y=X−44 . . . (3) Namely, by obtaining the corrected steps Y, the opening degree of the shutter value 33 can be corrected. By carrying out this type of correction, for example, the flowrate of the air or namely, the injection quantity of air being injected to the document bundle can be prevented from varying even if the performance of the separation fan or in the opening degree of the shutter valve is varied.

For example, if the rotation of the separation fan becomes slower and the rotation period $T_{44}$ becomes longer, the injection quantity of air will become smaller. In this case, because the rotation amount will become smaller, the number of steps X will also become smaller, the number of corrected steps Y will become a minus value resulting in the shutter valve 33 being corrected in the open direction. This allows the injection quantity of air being injected to the document to be corrected to be larger.

Figure 23:
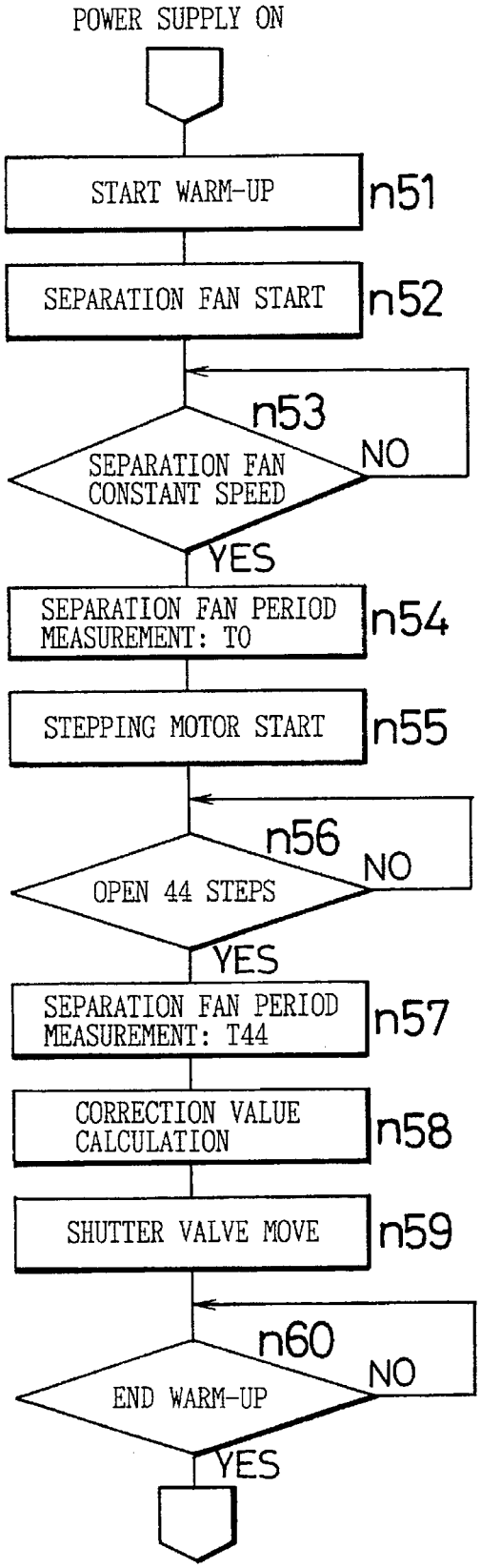
FIG. 23 is a flowchart showing a process related to the correction process of the shutter valve etc.

An actual example of control processing will be described. FIG. 23 is a flowchart showing this processing procedure.

In this example, the above correction process is carried out when the power supply of the copying machine main body is turned ON. Basically, when the power supply is turned ON and the apparatus enters the warm-up state, the separation fan operates and when the separation fan has sufficiently started, that rpm is detected (n51→n52→n53→n54).

The shutter valve 33 is fully closed at this time. Next, the shutter valve 33 changes to a fully open state (44 steps) and the rpm at that time is detected (n55→n56→n57). Then, based on both detection values, the number of corrected steps Y is obtained in the process described above to correct the origin point (n58→n59→n60).

Further, the case when document sheets are fed has been described in the description of the above embodiments, but is not limited to the documents sheet feeding apparatus for the document sheets. In other words, it is obvious that sheet-like copying paper can be fed in the same way. Moreover, without being limited to feeding sheets of a copying apparatus, this apparatus can be used in any type of device if the sheet feeding apparatus is such that it uses air to separate stacked sheets and then feeds those sheets after they are separated.

As this invention may be embodied in several forms without departing from the spirit of the essential characteristics, the present embodiment is therefore illustrative and not restrictive, and this invention is not limited to the specific embodiment thereof except as defined in the appended claims. Furthermore, modifications and changes within the scope of the appended claims may be made.

What is claimed:

1. A sheet feeding apparatus that separates individual sheets from a sheet bundle and thereafter feeds one sheet at a time by injecting air against the front edge of the sheet bundle, said apparatus comprising:

means for injecting air including a fan, a duct and a shutter, the duct running from the fan to the front edge of the sheet bundle and the shutter disposed inside the duct to open or close an air path in stages;

detecting means disposed on a sheet loading unit underneath the sheet bundle, the detecting means detecting a floating state of the sheet bundle from the sheet loading unit;

means for gradually varying the injection quantity of air by starting rotation of the fan with the shutter open; and means for setting the stages of opening and closing of the shutter to maintain the injection quantity of air at the time when the floating state of the sheet bundle to be detected by the detecting means changes after the start of the rotation of the fan.

2. The sheet feeding apparatus according to claim 1, wherein said plurality of contact-type sensors or distance measurement sensors providing means for detecting the floating state including a curling state of the bundle in response to the operational condition of each sensor; and means for controlling the injection quantity of air in response to said detected state.

3. The sheet feeding apparatus according to claim 2, wherein the contact-type sensors are mechanical sensors or photosensors.

4. A sheet feeding apparatus that separates individual sheets from a sheet bundle and thereafter feeds one sheet at a time by injecting air against the front edge of the sheet bundle, said apparatus comprising:

a distance measurement sensor disposed on a sheet loading unit underneath the sheet bundle, the sensor measuring the distance from the disposed position of the sensor to the lowermost portion of the stacked sheet bundle in the sheet loading unit to detect a floating state of sheet bundle;

means for injecting air to the front edge of the sheet bundle; and means for controlling the injection quantity of air by the air injection means such that the distance measured by the distance measurement sensor is a predetermined value while the sheet is made afloat by air injection with the air injection means.

5. The sheet feeding apparatus according to claim 4, wherein said plurality of contact-type sensors or distance measurement sensors providing means for detecting the floating state including a curling state of the bundle in response to the operational condition of each sensor; and means for controlling the injection quantity of air in response to said detected state.

6. The sheet feeding apparatus according to claim 5, wherein the contact-type sensors are mechanical sensors or photosensors.

7. The sheet feeding apparatus according to claim 4, wherein the measurement sensor includes a light emitting element operatively connected to a CPU, said CPU controlling a stepping motor, said means for controlling including said CPU and stepping motor.

8. A sheet feeding apparatus that separates individual sheets from a sheet bundle and thereafter feeds one sheet at a time by injecting air against the front edge of the sheet bundle, said apparatus comprising:

detecting means disposed on a sheet loading unit underneath the sheet bundle, for detecting a floating state of the sheet bundle from the sheet loading unit; and means for maintaining the injection quantity of air constant and at a constant pressure when the floating state of the sheet bundle detected by the detecting means changes after the start of the air injection; wherein said detecting means includes a plurality of contact-type sensors or distance measurement sensors said plurality of contact-type sensors or distance measurement sensors providing means for detecting the floating state including a curling state of the bundle in response to the operational condition of each sensor; and means for controlling the injection quantity of air in response to said detected state.

9. The sheet feeding apparatus according to claim 8, wherein the contact-type sensors are mechanical sensors or photosensors.

10. A sheet feeding apparatus that separates individual sheets from a sheet bundle and thereafter feeds one sheet at a time by injecting air against the front edge of the sheet bundle, said apparatus comprising:

detecting means disposed on a sheet loading unit underneath the sheet bundle, for detecting a floating state of the sheet bundle from the sheet loading unit prior to the start of the air injection and after the start of the air injection;

memory means for storing said floating state prior to and after the start of air injection;

means for gradually varying the injection quantity of air after the start of the air injection; and means for controlling the injection quantity of air in response to a relationship, stored in the memory means between the floating state of the sheet bundle after the start of the air injection and the floating state of the sheet bundle prior to the start of the air injection; wherein a plurality of contact-type sensors or distance measurement sensors providing the means for detecting the floating state including a curling state of the bundle in response to the operational condition of each sensor.

11. The sheet feeding apparatus according to claim 10, wherein the contact-type sensors are mechanical sensors or photosensors.

12. A sheet feeding apparatus that separates individual sheets from a sheet bundle and thereafter feeds one sheet at a time by injecting air against the front edge of the sheet bundle, said apparatus comprising:

detecting means disposed on a sheet loading unit underneath the sheet bundle, for detecting a floating state of the sheet bundle from the sheet loading unit; and means for maintaining the injection quantity of air constant and at a constant pressure when the floating state of the sheet bundle detected by the detecting means changes after the start of the air injection, wherein the sheet loading unit includes a belt means contiguous to a document tray and the detecting means is located at the belt means with a portion of the detection means protruding at an upper surface of the belt means.

13. The sheet feeding apparatus according to claim 12, wherein the belt means includes a plurality of belts and the detection means includes a plurality of sensors, with each sensor located between belts.

14. A sheet feeding apparatus that separates individual sheets form a sheet bundle and thereafter feeds one sheet at a time by injecting air against the front edge of the sheet bundle, said apparatus comprising:

detecting means disposed on a sheet loading unit underneath the sheet bundle, for detecting a floating state of the sheet bundle from the sheet loading unit; and means for maintaining the injection quantity of air constant and at a constant pressure when the floating state of the sheet bundle detected by the detecting means changes after the start of the air injection, wherein the means for maintaining the injection quantity of air includes a duct, a fan and a shutter valve for opening and closing the duct.

15. The sheet feeding apparatus according to claim 14, wherein the detecting means is operatively connected to a stepping motor, said stepping motor being operatively connected to the shutter valve.

16. The sheet feeding apparatus according to claim 14, wherein said duct includes an adjustable nozzle.

17. The sheet feeding apparatus according to claim 16 further including means to indicate a rotational position of the shutter valve.

* * * * *